US010883489B2

(12) United States Patent
Robol et al.

(10) Patent No.: US 10,883,489 B2
(45) **Date of Patent: *Jan. 5, 2021**

(54) FLOW LOCKING SYSTEM AND METHOD

(71) Applicant: Pentair Water Pool and Spa, Inc., Cary, NC (US)

(72) Inventors: Ronald B. Robol, Savannah, GA (US); Daniel J. Hruby, Sanford, NC (US); Rodney McCall, Greenville, SC (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/673,737

(22) Filed: Nov. 4, 2019

(65) Prior Publication Data

US 2020/0063734 A1 Feb. 27, 2020

Related U.S. Application Data

(63) Continuation of application No. 13/666,852, filed on Nov. 1, 2012, now Pat. No. 10,465,676.

(Continued)

(51) Int. Cl.
*F04B 49/10* (2006.01)
*F04B 19/00* (2006.01)

(Continued)

(52) U.S. Cl.
CPC ..... *F04B 49/106* (2013.01); *F04B 17/03* (2013.01); *F04B 19/00* (2013.01); *F04B 49/065* (2013.01);

(Continued)

(58) Field of Classification Search
CPC ..... F04B 17/03; F04B 49/065; F04B 49/06; F04B 2205/09; F04B 2207/04;

(Continued)

(56) References Cited

U.S. PATENT DOCUMENTS 1,061,919 A 5/1913 Miller
1,993,267 A 3/1935 Ferguson (Continued)

FOREIGN PATENT DOCUMENTS

DE 3023463 A1 2/1981
DE 2946049 A1 5/1981

(Continued)

OTHER PUBLICATIONS

54DX21—Danfoss; "VLT 8000 Aqua Instruction Manual;" Apr. 2004; 1-210; Cited in Civil Action 5:11-cv-00459D.

(Continued)

*Primary Examiner* — Bryan M Lettman

(74) *Attorney, Agent, or Firm* — Husch Blackwell LLP

(57) ABSTRACT

A pumping system and method including a flow locking feature. A pump controller includes a user interface configured to initially receive and set a plurality of programmed flow rate settings, a maximum locked flow rate, and a minimum locked flow rate. The pump controller is also configured to disable resetting of the maximum flow rate and the minimum flow rate once they are initially received and set and to allow resetting of the plurality of programmed flow rate settings throughout operation of the pumping system. The pump controller is further configured to operate a pump motor in order to maintain a first flow rate set by one of the plurality of programmed flow rate settings as long as the first flow rate is between the minimum locked flow rate and the maximum locked flow rate.

5 Claims, 7 Drawing Sheets

Related U.S. Application Data

(60) Provisional application No. 61/554,439, filed on Nov. 1, 2011.

(51) Int. Cl.

| | |
|---|---|
| ***F04B 49/20*** | (2006.01) |
| ***F04B 17/03*** | (2006.01) |
| ***F04B 49/06*** | (2006.01) |
| ***F04D 29/70*** | (2006.01) |
| ***F04D 15/00*** | (2006.01) |

(52) U.S. Cl.
CPC ..... *F04B 49/20* (2013.01); *F04D 15/0066* (2013.01); *F04D 29/708* (2013.01); *A61H 2201/5007* (2013.01); *A61H 2201/5038* (2013.01); *F04B 2201/1201* (2013.01); *F04B 2203/0209* (2013.01); *F04B 2205/09* (2013.01); *F04B 2207/041* (2013.01)

(58) Field of Classification Search
CPC ..... F04B 2207/044; F04B 2207/0441; F04B 2207/0442; F04B 2203/0209; F04B 19/00; F04B 49/20; F04B 49/106; F04B 2201/1201; F04B 2207/041–0413; A61H 33/0087; A61H 2201/5038; A61H 2201/0173; A61H 2201/5007; A61H 2033/0037; F04D 29/708; F04D 15/0066; F04D 27/004; F04D 27/0261; F04C 14/08; F04C 14/28; F04C 28/08; F04C 28/28; F04C 2270/05; F04C 2270/051; F04C 2270/20; F04C 2270/205
See application file for complete search history.

(56) References Cited

U.S. PATENT DOCUMENTS 2,238,597 A 4/1941 Page
2,458,006 A 1/1949 Kilgore
2,488,365 A 11/1949 Abbott Ward et al.
2,494,200 A 1/1950 Ramqvist
2,615,937 A 10/1952 Ludwig et al.
2,716,195 A 8/1955 Anderson
2,767,277 A 10/1956 Wirth
2,778,958 A 1/1957 Hamm et al.
2,881,337 A 4/1959 Wall
3,116,445 A 12/1963 Wright
3,191,935 A 6/1965 Uecker
3,204,423 A 9/1965 Resh, Jr.
3,213,304 A 10/1965 Landberg et al.
3,226,620 A 12/1965 Elliott et al.
3,227,808 A 1/1966 Morris et al.
3,291,058 A 12/1966 McFarlin
3,481,973 A 12/1969 Arons et al.
3,530,348 A 9/1970 Conner
3,558,910 A 1/1971 Dale et al.
3,559,731 A 2/1971 Stafford
3,562,614 A 2/1971 Gramkow
3,566,225 A 2/1971 Poulsen
3,573,579 A 4/1971 Lewus
3,581,895 A 6/1971 Howard et al.
3,593,081 A 7/1971 Forst
3,594,623 A 7/1971 Lamaster
3,596,158 A 7/1971 Watrous
3,613,805 A 10/1971 Lindstad et al.
3,624,470 A 11/1971 Johnson
3,652,912 A 3/1972 Bordonaro
3,671,830 A 6/1972 Kruper
3,737,749 A 6/1973 Schmit
3,761,792 A 9/1973 Whitney et al.
3,777,232 A 12/1973 Woods et al.
3,778,804 A 12/1973 Adair
3,780,759 A 12/1973 Yahle
3,781,925 A 1/1974 Curtis et al.
3,787,882 A 1/1974 West et al.
3,792,324 A 2/1974 Suarez et al.
3,800,205 A 3/1974 Zalar
3,838,597 A 10/1974 Montgomery et al.
3,882,364 A 5/1975 Wright
3,902,369 A 9/1975 Metz
3,913,342 A 10/1975 Barry
3,916,274 A 10/1975 Lewus
3,949,782 A 4/1976 Athey et al.
3,953,152 A 4/1976 Sipin
3,953,777 A 4/1976 McKee
3,956,760 A 5/1976 Edwards
3,963,375 A 6/1976 Curtis
3,976,919 A 8/1976 Vandevier et al.
4,000,446 A 12/1976 Vandevier et al.
4,021,700 A 5/1977 Ellis-Anwyl
4,041,470 A 8/1977 Slane et al.
4,061,442 A 12/1977 Clark et al.
4,123,792 A 10/1978 Gephart et al.
4,133,058 A 1/1979 Baker
4,142,415 A 3/1979 Jung et al.
4,151,080 A 4/1979 Zuckerman et al.
4,168,413 A 9/1979 Halpine
4,182,363 A 1/1980 Fuller
4,185,187 A 1/1980 Rogers
4,206,634 A 6/1980 Taylor et al.
4,225,290 A 9/1980 Allington
4,241,299 A 12/1980 Bertone
4,263,535 A 4/1981 Jones
4,276,454 A 6/1981 Zathan
4,286,303 A 8/1981 Genheimer et al.
4,303,203 A 12/1981 Avery
4,307,327 A 12/1981 Streater et al.
4,314,478 A 2/1982 Beaman
4,319,712 A 3/1982 Bar
4,322,297 A 3/1982 Bajka
4,353,220 A 10/1982 Curwen et al.
4,366,426 A 12/1982 Turlej
4,370,098 A 1/1983 McClain et al.
4,370,690 A 1/1983 Baker
4,371,315 A 2/1983 Shikasho
4,375,613 A 3/1983 Fuller et al.
4,384,825 A 5/1983 Thomas et al.
4,399,394 A 8/1983 Ballman
4,402,094 A 9/1983 Sanders
4,409,532 A 10/1983 Hollenbeck et al.
4,419,625 A 12/1983 Bejot et al.
4,420,787 A 12/1983 Tibbits et al.
4,421,643 A 12/1983 Frederick
4,427,545 A 1/1984 Arguilez
4,428,434 A 1/1984 Gelaude
4,429,343 A 1/1984 Freud
4,437,133 A 3/1984 Rueckert
4,448,072 A 5/1984 Tward
4,449,260 A 5/1984 Whitaker
4,453,118 A 6/1984 Phillips et al.
4,462,758 A 7/1984 Speed
4,463,304 A 7/1984 Miller
4,468,604 A 8/1984 Zaderej
4,470,092 A 9/1984 Lombardi
4,473,338 A 9/1984 Garmong
4,494,180 A 1/1985 Streater
4,496,895 A 1/1985 Kawate et al.
4,504,773 A 3/1985 Suzuki et al.
4,505,643 A 3/1985 Millis et al.
D278,529 S 4/1985 Hoogner
4,514,989 A 5/1985 Mount
4,520,303 A 5/1985 Ward
4,541,029 A 9/1985 Ohyama
4,545,906 A 10/1985 Frederick
4,564,882 A 1/1986 Baxter et al.
4,581,900 A 4/1986 Lowe et al.
4,604,563 A 8/1986 Min
4,605,888 A 8/1986 Kim
4,610,605 A 9/1986 Hartley
4,620,835 A 11/1986 Bell
4,622,506 A 11/1986 Shemanske et al.
4,635,441 A 1/1987 Ebbing et al.
4,647,825 A 3/1987 Profio et al.

(56) References Cited

U.S. PATENT DOCUMENTS 4,651,077 A 3/1987 Woyski
4,658,195 A 4/1987 Min
4,658,203 A 4/1987 Freymuth
4,670,697 A 6/1987 Wrege et al.
4,676,914 A 6/1987 Mills et al.
4,678,404 A 7/1987 Lorett et al.
4,678,409 A 7/1987 Kurokawa
4,686,439 A 8/1987 Cunningham et al.
4,695,779 A 9/1987 Yates
4,697,464 A 10/1987 Martin
4,703,387 A 10/1987 Miller
4,705,629 A 11/1987 Weir et al.
4,716,605 A 1/1988 Shepherd et al.
4,719,399 A 1/1988 Wrege
4,728,882 A 3/1988 Stanbro et al.
4,751,449 A 6/1988 Chmiel
4,751,450 A 6/1988 Lorenz et al.
4,758,697 A 7/1988 Jeuneu
4,761,601 A 8/1988 Zaderej
4,764,417 A 8/1988 Gulya
4,764,714 A 8/1988 Alley et al.
4,767,280 A 8/1988 Markuson et al.
4,780,050 A 10/1988 Caine et al.
4,781,525 A 11/1988 Hubbard et al.
4,782,278 A 11/1988 Bossi et al.
4,786,850 A 11/1988 Chmiel
4,795,314 A 1/1989 Prybella et al.
4,801,858 A 1/1989 Min
4,804,901 A 2/1989 Pertessis et al.
4,820,964 A 4/1989 Kadah et al.
4,827,197 A 5/1989 Giebeler
4,834,624 A 5/1989 Jensen et al.
4,837,656 A 6/1989 Barnes
4,839,571 A 6/1989 Farnham et al.
4,841,404 A 6/1989 Marshall et al.
4,843,295 A 6/1989 Thompson et al.
4,862,053 A 8/1989 Jordan et al.
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi et al.
4,958,118 A 9/1990 Pottebaum
4,963,778 A 10/1990 Jensen et al.
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs
4,998,097 A 3/1991 Noth et al.
5,017,853 A 5/1991 Chmiel
5,026,256 A 6/1991 Kuwabara et al.
5,041,771 A 8/1991 Min
5,051,681 A 9/1991 Schwarz
5,076,761 A 12/1991 Krohn et al.
5,076,763 A 12/1991 Anastos et al.
5,079,784 A 1/1992 Rist et al.
5,091,817 A 2/1992 Alley et al.
5,098,023 A 3/1992 Burke
5,099,181 A 3/1992 Canon
5,100,298 A 3/1992 Shibata et al.
RE33,874 E 4/1992 Miller
5,103,154 A 4/1992 Dropps et al.
5,117,233 A 5/1992 Hamos et al.
5,123,080 A 6/1992 Gillett et al.
5,145,323 A 9/1992 Farr
5,151,017 A 9/1992 Sears et al.
5,156,535 A 10/1992 Budris et al.
5,158,436 A 10/1992 Jensen et al.
5,159,713 A 10/1992 Gaskill et al.
5,164,651 A 11/1992 Hu et al.
5,167,041 A 12/1992 Burkitt
5,172,089 A 12/1992 Wright et al.
D334,542 S 4/1993 Lowe et al.
5,206,573 A 4/1993 McCleer et al.
5,213,477 A 5/1993 Watanabe et al.
5,234,286 A 8/1993 Wagner
5,235,235 A 8/1993 Martin et al.
5,238,369 A 8/1993 Farr
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier et al.
5,295,790 A 3/1994 Bossart et al.
5,296,795 A 3/1994 Dropps et al.
5,302,885 A 4/1994 Schwarz et al.
5,324,170 A 6/1994 Anastos et al.
5,327,036 A 7/1994 Carey
5,342,176 A 8/1994 Redlich
5,347,664 A 9/1994 Hamza et al.
5,351,709 A 10/1994 Vos
5,351,714 A 10/1994 Barnowski
5,361,215 A 11/1994 Tompkins et al.
5,394,748 A 3/1995 McCarthy
5,418,984 A 5/1995 Livingston, Jr.
D359,458 S 6/1995 Pierret et al.
5,422,014 A 6/1995 Allen et al.
5,423,214 A 6/1995 Lee
5,444,354 A 8/1995 Takahashi et al.
D363,060 S 10/1995 Hunger et al.
5,471,125 A 11/1995 Wu
5,473,497 A 12/1995 Beatty
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein et al.
5,519,848 A 5/1996 Wloka et al.
5,520,517 A 5/1996 Sipin
5,528,120 A 6/1996 Brodetsky
5,532,635 A 7/1996 Watrous et al.
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill et al.
5,550,497 A 8/1996 Carobolante
5,550,753 A 8/1996 Tompkins et al.
5,559,418 A 9/1996 Burkhart
5,559,720 A 9/1996 Tompkins et al.
5,559,762 A 9/1996 Sakamoto
5,561,357 A 10/1996 Schroeder
5,563,759 A 10/1996 Nadd
D375,908 S 11/1996 Schumaker et al.
5,570,481 A 11/1996 Mathis et al.
5,571,000 A 11/1996 Zimmermann et al.
5,577,890 A 11/1996 Nielsen et al.
5,580,221 A 12/1996 Triezenberg
5,589,753 A 12/1996 Kadah et al.
5,592,062 A 1/1997 Bach
5,598,080 A 1/1997 Jensen et al.
5,601,413 A 2/1997 Langley et al.
5,604,491 A 2/1997 Coonley et al.
5,614,812 A 3/1997 Wagoner
5,618,460 A 4/1997 Fowler et al.
5,624,237 A 4/1997 Prescott et al.
5,626,464 A 5/1997 Schoenmeyr et al.
5,628,896 A 5/1997 Klingenberger
5,632,468 A 5/1997 Schoenmeyr
5,633,540 A 5/1997 Moan
5,654,504 A 8/1997 Smith et al.
5,654,620 A 8/1997 Langhorst
5,672,050 A 9/1997 Webber et al.
5,682,624 A 11/1997 Ciochetti
5,690,476 A 11/1997 Miller
5,711,483 A 1/1998 Hays

(56) References Cited

U.S. PATENT DOCUMENTS 5,713,320 A 2/1998 Pfaff et al.
5,727,933 A 3/1998 Laskaris et al.
5,730,861 A 3/1998 Sterghos et al.
5,731,673 A 3/1998 Gilmore
5,736,884 A 4/1998 Ettes et al.
5,739,648 A 4/1998 Ellis et al.
5,744,921 A 4/1998 Makaran
5,754,036 A 5/1998 Walker
5,754,421 A 5/1998 Nystrom
5,755,563 A 5/1998 Clegg et al.
5,767,606 A 6/1998 Bresolin
5,777,833 A 7/1998 Romillon
5,791,882 A 8/1998 Stucker et al.
5,804,080 A 9/1998 Klingenberger
5,808,441 A 9/1998 Nehring
5,814,966 A 9/1998 Williamson et al.
5,818,708 A 10/1998 Wong
5,818,714 A 10/1998 Zou et al.
5,819,848 A 10/1998 Rasmuson et al.
5,820,350 A 10/1998 Mantey et al.
5,828,200 A 10/1998 Ligman et al.
5,833,437 A 11/1998 Kurth et al.
5,836,271 A 11/1998 Sasaki et al.
5,856,783 A 1/1999 Gibb
5,863,185 A 1/1999 Cochimin et al.
5,883,489 A 3/1999 Konrad
5,892,349 A 4/1999 Bogwicz et al.
5,894,609 A 4/1999 Barnett
5,907,281 A 5/1999 Miller et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,935,099 A 8/1999 Peterson et al.
5,941,690 A 8/1999 Lin
5,945,802 A 8/1999 Konrad et al.
5,947,689 A 9/1999 Schick
5,947,700 A 9/1999 McKain et al.
5,959,534 A 9/1999 Campbell et al.
5,961,291 A 10/1999 Sakagami et al.
5,969,958 A 10/1999 Nielsen et al.
5,973,465 A 10/1999 Rayner
5,973,473 A 10/1999 Anderson et al.
5,977,732 A 11/1999 Matsumoto
5,983,146 A 11/1999 Sarbach
5,991,939 A 11/1999 Mulvey
6,030,180 A 2/2000 Clarey et al.
6,037,742 A 3/2000 Rasmussen
6,043,461 A 3/2000 Holling et al.
6,045,331 A 4/2000 Gehm et al.
6,045,333 A 4/2000 Breit
6,046,492 A 4/2000 Machida et al.
6,048,183 A 4/2000 Meza
6,059,536 A 5/2000 Stingl
6,065,946 A 5/2000 Lathrop
6,072,291 A 6/2000 Pedersen
6,081,751 A 6/2000 Luo et al.
6,091,604 A 7/2000 Plougsgaard et al.
6,092,992 A 7/2000 Imblum et al.
D429,699 S 8/2000 Davis et al.
D429,700 S 8/2000 Liebig
6,098,654 A 8/2000 Cohen et al.
6,102,665 A 8/2000 Centers et al.
6,110,322 A 8/2000 Teoh et al.
6,116,040 A 9/2000 Stark
6,121,746 A 9/2000 Fisher et al.
6,125,481 A 10/2000 Sicilano
6,142,741 A 11/2000 Nishihata et al.
6,157,304 A 12/2000 Bennett et al.
6,164,132 A 12/2000 Matulek
6,171,073 B1 1/2001 McKain et al.
6,178,393 B1 1/2001 Irvin
6,199,224 B1 3/2001 Versland
6,208,112 B1 3/2001 Jensen et al.
6,212,956 B1 4/2001 Donald et al.
6,213,724 B1 4/2001 Haugen et al.
6,216,814 B1 4/2001 Fujita et al.
6,222,355 B1 4/2001 Ohshima et al.
6,227,808 B1 5/2001 McDonough
6,232,742 B1 5/2001 Wacknov et al.
6,236,177 B1 5/2001 Zick et al.
6,238,188 B1 5/2001 Lifson
6,247,429 B1 6/2001 Hara et al.
6,249,435 B1 6/2001 Vicente et al.
6,251,285 B1 6/2001 Ciochetti
6,253,227 B1 6/2001 Tompkins et al.
D445,405 S 7/2001 Schneider et al.
6,254,353 B1 7/2001 Polo et al.
6,257,304 B1 7/2001 Jacobs et al.
6,259,617 B1 7/2001 Wu
6,264,431 B1 7/2001 Triezenberg
6,264,432 B1 7/2001 Kilayko et al.
6,280,611 B1 8/2001 Henkin et al.
6,299,414 B1 10/2001 Schoenmeyr
6,299,699 B1 10/2001 Porat et al.
6,320,348 B1 11/2001 Kadah
6,326,752 B1 12/2001 Jensen et al.
6,329,784 B1 12/2001 Puppin et al.
6,330,525 B1 12/2001 Hays et al.
6,342,841 B1 1/2002 Stingl
6,349,268 B1 2/2002 Ketonen et al.
6,350,105 B1 2/2002 Kobayashi et al.
6,351,359 B1 2/2002 Jeager
6,354,805 B1 3/2002 Moller
6,356,464 B1 3/2002 Balakrishnan et al.
6,362,591 B1 3/2002 Moberg
6,364,621 B1 4/2002 Yamauchi
6,366,481 B1 4/2002 Balakrishnan et al.
6,373,204 B1 4/2002 Peterson et al.
6,373,728 B1 4/2002 Aarestrup
6,374,854 B1 4/2002 Acosta
6,380,707 B1 4/2002 Rosholm et al.
6,388,642 B1 5/2002 Cotis
6,390,781 B1 5/2002 McDonough
6,406,265 B1 6/2002 Hahn et al.
6,411,481 B1 6/2002 Seubert
6,415,808 B2 7/2002 Joshi
6,416,295 B1 7/2002 Nagai et al.
6,426,633 B1 7/2002 Thybo
6,445,565 B1 9/2002 Toyoda et al.
6,447,446 B1 9/2002 Smith et al.
6,448,713 B1 9/2002 Farkas et al.
6,450,771 B1 9/2002 Centers et al.
6,462,971 B1 10/2002 Balakrishnan et al.
6,464,464 B2 10/2002 Sabini et al.
6,468,042 B2 10/2002 Moller
6,468,052 B2 10/2002 McKain et al.
6,474,949 B1 11/2002 Arai et al.
6,481,973 B1 11/2002 Struthers
6,483,278 B2 11/2002 Harvest
6,483,378 B2 11/2002 Blodgett
6,490,920 B1 12/2002 Netzer
6,493,227 B2 12/2002 Nielsen et al.
6,496,392 B2 12/2002 Odell
6,499,961 B1 12/2002 Wyatt et al.
6,501,629 B1 12/2002 Marriott
6,504,338 B1 1/2003 Eichorn
6,520,010 B1 2/2003 Bergveld et al.
6,522,034 B1 2/2003 Nakayama
6,523,091 B2 2/2003 Tirumala et al.
6,534,940 B2 3/2003 Bell et al.
6,534,947 B2 3/2003 Johnson et al.
6,537,032 B1 3/2003 Horiuchi et al.
6,538,908 B2 3/2003 Balakrishnan et al.
6,539,797 B2 4/2003 Livingston et al.
6,543,940 B2 4/2003 Chu
6,548,976 B2 4/2003 Jensen et al.
6,564,627 B1 5/2003 Sabini et al.
6,590,188 B2 7/2003 Cline et al.
6,591,697 B2 7/2003 Henyan
6,591,863 B2 7/2003 Ruschell et al.
6,595,762 B2 7/2003 Khanwilkar et al.
6,604,909 B2 8/2003 Schoenmeyr

(56) References Cited

U.S. PATENT DOCUMENTS 6,607,360 B2 8/2003 Fong
6,616,413 B2 9/2003 Humpheries
6,623,245 B2 9/2003 Meza et al.
6,628,501 B2 9/2003 Toyoda
6,636,135 B1 10/2003 Vetter
6,638,023 B2 10/2003 Scott
D482,664 S 11/2003 Hunt et al.
6,643,153 B2 11/2003 Balakrishnan et al.
6,651,900 B1 11/2003 Yoshida
6,665,200 B2 12/2003 Goto et al.
6,672,147 B1 1/2004 Mazet
6,675,912 B2 1/2004 Carrier
6,676,831 B2 1/2004 Wolfe
6,687,141 B2 2/2004 Odell
6,687,923 B2 2/2004 Dick et al.
6,690,250 B2 2/2004 Moller
6,696,676 B1 2/2004 Graves et al.
6,700,333 B1 3/2004 Hirshi et al.
6,709,240 B1 3/2004 Schmalz et al.
6,709,241 B2 3/2004 Sabini et al.
6,709,575 B1 3/2004 Verdegan et al.
6,715,996 B2 4/2004 Moeller
6,717,318 B1 4/2004 Mathiassen
6,732,387 B1 5/2004 Waldron
6,737,905 B1 5/2004 Noda et al.
D490,726 S 6/2004 Eungprabhanth et al.
6,742,387 B2 6/2004 Hamamoto et al.
6,747,367 B2 6/2004 Cline et al.
6,761,067 B1 7/2004 Capano
6,768,279 B1 7/2004 Skinner et al.
6,770,043 B1 8/2004 Kahn
6,774,664 B2 8/2004 Godbersen
6,776,584 B2 8/2004 Sabini et al.
6,778,868 B2 8/2004 Imamura et al.
6,779,205 B2 8/2004 Mulvey et al.
6,782,309 B2 8/2004 Laflamme et al.
6,783,328 B2 8/2004 Lucke et al.
6,794,921 B2 9/2004 Abe et al.
6,797,164 B2 9/2004 Leaverton
6,798,271 B2 9/2004 Swize
6,799,950 B2 10/2004 Meier et al.
6,806,677 B2 10/2004 Kelly et al.
6,837,688 B2 1/2005 Kimberlin et al.
6,842,117 B2 1/2005 Keown
6,847,854 B2 1/2005 Discenzo
6,863,502 B2 3/2005 Bishop et al.
6,875,961 B1 4/2005 Collins
6,882,165 B2 4/2005 Ogura
6,884,022 B2 4/2005 Albright et al.
D504,900 S 5/2005 Wang
D505,429 S 5/2005 Wang
6,888,537 B2 5/2005 Benson et al.
6,895,608 B2 5/2005 Goettl
6,900,736 B2 5/2005 Crumb
6,906,482 B2 6/2005 Shimizu et al.
D507,243 S 7/2005 Miller
6,914,793 B2 7/2005 Balakrishnan et al.
6,922,348 B2 7/2005 Nakajima et al.
6,925,823 B2 8/2005 Lifson et al.
6,933,693 B2 8/2005 Schuchmann
6,941,785 B2 9/2005 Haynes et al.
6,943,325 B2 9/2005 Pittman et al.
D511,530 S 11/2005 Wang
D512,026 S 11/2005 Nurmi et al.
6,965,815 B1 11/2005 Tompkins et al.
D512,440 S 12/2005 Wang
6,973,794 B2 12/2005 Street et al.
6,976,052 B2 12/2005 Tompkins et al.
D513,737 S 1/2006 Riley
6,981,399 B1 1/2006 Nybo et al.
6,981,402 B2 1/2006 Bristol
6,984,158 B2 1/2006 Satoh et al.
6,989,649 B2 1/2006 Mehlhorn
6,993,414 B2 1/2006 Shah
7,005,818 B2 2/2006 Jensen
7,040,107 B2 5/2006 Lee et al.
7,050,278 B2 5/2006 Poulsen
7,055,189 B2 6/2006 Goettl
7,080,508 B2 7/2006 Stavale et al.
7,083,392 B2 8/2006 Meza et al.
7,112,037 B2 9/2006 Sabini et al.
7,114,926 B2 10/2006 Oshita et al.
7,117,120 B2 10/2006 Beck et al.
7,141,210 B2 11/2006 Bell et al.
7,142,932 B2 11/2006 Spira et al.
7,143,016 B1 11/2006 Discenzo et al.
D533,512 S 12/2006 Nakashima et al.
7,163,380 B2 1/2007 Jones
7,178,179 B2 2/2007 Barnes
7,183,741 B2 2/2007 Mehlhorn
7,195,462 B2 3/2007 Nybo et al.
7,221,121 B2 5/2007 Skaug et al.
7,244,106 B2 7/2007 Kallman et al.
7,245,105 B2 7/2007 Joo et al.
7,318,344 B2 1/2008 Heger
D562,349 S 2/2008 Bülter
7,327,275 B2 2/2008 Brochu et al.
D567,189 S 4/2008 Stiles, Jr. et al.
7,407,371 B2 8/2008 Leone et al.
7,427,844 B2 9/2008 Mehlhorn
7,437,215 B2 10/2008 Anderson et al.
D582,797 S 12/2008 Fraser et al.
D583,828 S 12/2008 Li et al.
7,484,938 B2 2/2009 Allen
7,516,106 B2 4/2009 Ehlers et al.
7,542,251 B2 6/2009 Ivankovic
7,612,510 B2 11/2009 Koehl
7,623,986 B2 11/2009 Miller
7,641,449 B2 1/2010 Iimura et al.
7,652,441 B2 1/2010 Ying Yin Ho
7,686,589 B2 3/2010 Stiles, Jr. et al.
7,690,897 B2 4/2010 Branecky et al.
7,727,181 B2 6/2010 Rush
7,739,733 B2 6/2010 Szydlo
7,775,327 B2 8/2010 Abraham et al.
7,777,435 B2 8/2010 Aguilar et al.
7,821,215 B2 10/2010 Koehl
7,845,913 B2 12/2010 Stiles, Jr. et al.
7,854,597 B2 12/2010 Stiles, Jr. et al.
7,857,600 B2 12/2010 Koehl
7,874,808 B2 1/2011 Stiles
7,925,385 B2 4/2011 Stavale et al.
7,931,447 B2 4/2011 Levin et al.
7,945,411 B2 5/2011 Kernan et al.
7,976,284 B2 7/2011 Koehl
7,983,877 B2 7/2011 Koehl
7,990,091 B2 8/2011 Koehl
8,011,895 B2 9/2011 Ruffo
8,019,479 B2 9/2011 Stiles et al.
8,043,070 B2 10/2011 Stiles, Jr. et al.
8,104,110 B2 1/2012 Caudill et al.
8,126,574 B2 2/2012 Discenzo et al.
8,133,034 B2 3/2012 Mehlhorn et al.
8,177,520 B2 5/2012 Mehlhorn et al.
8,281,425 B2 10/2012 Cohen
8,303,260 B2 11/2012 Stavale et al.
8,313,306 B2 11/2012 Stiles, Jr. et al.
8,317,485 B2 11/2012 Meza et al.
8,337,166 B2 12/2012 Meza et al.
8,444,394 B2 5/2013 Koehl
8,465,262 B2 6/2013 Stiles, Jr. et al.
8,469,675 B2 6/2013 Stiles, Jr. et al.
8,480,373 B2 7/2013 Stiles, Jr. et al.
8,540,493 B2 9/2013 Koehl
8,573,952 B2 11/2013 Stiles, Jr. et al.
8,602,745 B2 12/2013 Stiles, Jr. et al.
8,641,383 B2 2/2014 Meza et al.
2001/0002238 A1 5/2001 McKain et al.
2001/0041139 A1 11/2001 Sabini et al.
2002/0002989 A1 1/2002 Jones
2002/0089236 A1 7/2002 Cline et al.
2002/0093306 A1 7/2002 Johnson et al.
2002/0111554 A1 8/2002 Drzewiecki et al.
2002/0131866 A1 9/2002 Phillips

(56) References Cited

U.S. PATENT DOCUMENTS

| | | | |
|---|---|---|---|
| 2002/0136642 | A1 | 9/2002 | Moller |
| 2002/0176783 | A1 | 11/2002 | Moeller |
| 2002/0190687 | A1 | 12/2002 | Bell et al. |
| 2003/0034284 | A1 | 2/2003 | Wolfe |
| 2003/0061004 | A1 | 3/2003 | Discenzo |
| 2003/0063900 | A1 | 4/2003 | Wang et al. |
| 2003/0099548 | A1 | 5/2003 | Meza et al. |
| 2003/0106147 | A1 | 6/2003 | Cohen et al. |
| 2003/0196942 | A1 | 10/2003 | Jones |
| 2004/0000525 | A1 | 1/2004 | Hornsby |
| 2004/0006486 | A1 | 1/2004 | Schmidt et al. |
| 2004/0009075 | A1 | 1/2004 | Meza et al. |
| 2004/0013531 | A1 | 1/2004 | Curry et al. |
| 2004/0025244 | A1 | 2/2004 | Loyd et al. |
| 2004/0062658 | A1 | 4/2004 | Beck et al. |
| 2004/0090197 | A1 | 5/2004 | Schuchmann |
| 2004/0116241 | A1 | 6/2004 | Ishikawa et al. |
| 2004/0148693 | A1 | 8/2004 | Anderson |
| 2004/0213676 | A1 | 10/2004 | Phillips et al. |
| 2005/0050908 | A1 | 3/2005 | Lee et al. |
| 2005/0086957 | A1 | 4/2005 | Lifson et al. |
| 2005/0133088 | A1 | 6/2005 | Bologeorges |
| 2005/0170936 | A1 | 8/2005 | Quinn |
| 2005/0190094 | A1 | 9/2005 | Andersen |
| 2005/0193485 | A1 | 9/2005 | Wolfe |
| 2005/0195545 | A1 | 9/2005 | Mladenik et al. |
| 2005/0226731 | A1 | 10/2005 | Mehlhorn et al. |
| 2005/0249606 | A1 | 11/2005 | Rush |
| 2006/0045750 | A1 | 3/2006 | Stiles |
| 2006/0045751 | A1 | 3/2006 | Beckman et al. |
| 2006/0090255 | A1 | 5/2006 | Cohen |
| 2006/0138033 | A1 | 6/2006 | Hoal et al. |
| 2006/0146462 | A1 | 7/2006 | McMillian |
| 2006/0169322 | A1 | 8/2006 | Torkelson |
| 2006/0235573 | A1 | 10/2006 | Guion |
| 2006/0242955 | A1 | 11/2006 | Mauch |
| 2007/0041845 | A1 | 2/2007 | Freudenberger |
| 2007/0061051 | A1 | 3/2007 | Maddox |
| 2007/0118194 | A1 | 5/2007 | Mason et al. |
| 2007/0154319 | A1 | 7/2007 | Stiles et al. |
| 2007/0160480 | A1 | 7/2007 | Ruffo |
| 2008/0039977 | A1 | 2/2008 | Clark et al. |
| 2008/0095638 | A1 | 4/2008 | Branecky |
| 2008/0095639 | A1 | 4/2008 | Bartos et al. |
| 2008/0131289 | A1 | 6/2008 | Koehl |
| 2008/0131294 | A1 | 6/2008 | Koehl |
| 2008/0131295 | A1 | 6/2008 | Koehl |
| 2008/0152508 | A1 | 6/2008 | Meza et al. |
| 2008/0168599 | A1 | 7/2008 | Caudill et al. |
| 2008/0181785 | A1 | 7/2008 | Koehl |
| 2008/0181786 | A1 | 7/2008 | Meza et al. |
| 2008/0181787 | A1 | 7/2008 | Koehl |
| 2008/0181789 | A1 | 7/2008 | Koehl |
| 2008/0189885 | A1 | 8/2008 | Erlich et al. |
| 2008/0260540 | A1 | 10/2008 | Koehl |
| 2008/0288115 | A1 | 11/2008 | Rusnak et al. |
| 2009/0014044 | A1 | 1/2009 | Hartman et al. |
| 2009/0052281 | A1 | 2/2009 | Nybo et al. |
| 2009/0093774 | A1 | 4/2009 | Wang et al. |
| 2009/0099406 | A1 | 4/2009 | Salmonsen et al. |
| 2009/0204237 | A1 | 8/2009 | Sustaeta et al. |
| 2009/0204267 | A1 | 8/2009 | Sustaeta et al. |
| 2009/0210081 | A1 | 8/2009 | Sustaeta et al. |
| 2010/0092308 | A1 | 4/2010 | Stiles, Jr. et al. |
| 2010/0312398 | A1 | 12/2010 | Kidd et al. |
| 2011/0044823 | A1 | 2/2011 | Stiles |
| 2011/0052416 | A1 | 3/2011 | Stiles |
| 2011/0259428 | A1 | 10/2011 | Osborne |

FOREIGN PATENT DOCUMENTS

| | | | |
|---|---|---|---|
| DE | 19645129 | A1 | 5/1998 |
| DE | 19736079 | A1 | 2/1999 |
| DE | 29724347 | U1 | 12/2000 |
| DE | 19938490 | A1 | 3/2001 |
| DE | 10231773 | A1 | 2/2004 |
| EP | 150068 | A2 | 7/1985 |
| EP | 226858 | A1 | 7/1987 |
| EP | 246769 | A2 | 11/1987 |
| EP | 306814 | A1 | 3/1989 |
| EP | 314249 | A2 | 5/1989 |
| EP | 709575 | A1 | 5/1996 |
| EP | 735273 | A1 | 10/1996 |
| EP | 831188 | A2 | 3/1998 |
| EP | 833436 | A2 | 4/1998 |
| EP | 978657 | A1 | 2/2000 |
| EP | 1134421 | A1 | 9/2001 |
| EP | 1585205 | A2 | 10/2005 |
| EP | 1698815 | A1 | 9/2006 |
| FR | 2529965 | A1 | 1/1984 |
| FR | 2703409 | A1 | 10/1994 |
| GB | 2124304 | A | 2/1984 |
| JP | 55072678 | A | 5/1980 |
| JP | H5010270 | A | 1/1993 |
| WO | 9804835 | A1 | 2/1998 |
| WO | 0042339 | A1 | 7/2000 |
| WO | 0127508 | A1 | 4/2001 |
| WO | 0147099 | A1 | 6/2001 |
| WO | 0218826 | A1 | 3/2002 |
| WO | 03025442 | A1 | 3/2003 |
| WO | 03099705 | A2 | 12/2003 |
| WO | 2004006416 | A1 | 1/2004 |
| WO | 2004073772 | A1 | 9/2004 |
| WO | 2004088694 | A1 | 10/2004 |
| WO | 2005011473 | A2 | 2/2005 |
| WO | 2005111473 | A2 | 11/2005 |
| WO | 2006069568 | A1 | 7/2006 |

OTHER PUBLICATIONS

Danfoss; "VLT8000 Aqua Instruction Manual;" Apr. 16, 2004; pp. 1-71.

Shabnam Mogharabi; "Better, Stronger, Faster;" Pool and Spa News; pp. 1-5; Sep. 3, 2004; www/poolspanews.com.

Energy-Efficiency and Service Life; pp. 1-4; Nov. 2005; www/pentairpool.com.

Grundfos; "CU301 Installation & Operating Instructions;" Sep. 2005; pp. 1-30; Olathe, KS USA.

ITT Corporation; "Goulds Pumps Balanced Flow Constant Pressure Controller for 2 HP Submersible Pumps;" Jun. 2005; pp. 1-4 USA.

ITT Corporation; "Goulds Pumps Balanced Flow Constant Pressure Controller for 3 HP Submersible Pumps;" Jun. 2005; pp. 1-4; USA.

54DX46—Hopkins; "High-Temperature, High-Density . . . Embedded Operation;" pp. 1-6; cited in Civil Action 5:11-cv-00459D; Mar. 2006.

Franklin Electric; Constant Pressure in Just the Right Size; Aug. 2006; pp. 1-4; Bluffton, IN USA.

ITT Corporation; "Goulds Pumps Balanced Flow;" Jul. 2006; pp. 1-8.

Pentair Water Pool and Spa, Inc.; "The Pool Pro's Guide to Breakthrough Efficiency, Convenience & Profitability;" pp. 1-8; Mar. 2006; wwwpentairpool.com.

ITT Corporation; "Goulds Pumps Balanced Flow Submersible Pump Controller;" Jul. 2007; pp. 1-12.

Franklin Electric; "Monodrive MonodriveXT Single-Phase Constant Pressure;" Sep. 2008; pp. 1-2; Bluffton, IN USA.

SJE-Rhombus; "SubCon Variable Frequency Drive;" Dec. 2008; pp. 1-2; Detroit Lakes, MN USA.

SJE-Rhombus; "Variable Frequency Drives for Constant Pressure Control;" Aug. 2008; pp. 1-4; Detroit Lakes, MN USA.

Grundfos; "CU301 Installation & Operation Manual;" Apr. 2009; pp. 1-2; Undated; www.grundfos.com.

SJE-Rhombus; "Constant Pressure Controller for Submersible Well Pumps;" Jan. 2009; pp. 1-4; Detroit Lakes, MN USA.

9PX-42—Hayward Pool Systems; "Hayward EcoStar & EcoStar SVRS Variable Speed Pumps Brochure;" Civil Action 5:11-cv-00459D; 2010.

9PX16—Hayward Pool Products; "EcoStar Owner's Manual (Rev. B);" pp. 1-32; Elizabeth, NJ; cited in Civil Action 5:11-cv-00459D; 2010.

(56) References Cited

OTHER PUBLICATIONS

9PX22—Hayward Pool Products; "Wireless & Wired Remote Controls Brochure;" pp. 1-5; 2010; Elizabeth, NJ; cited in Civil Action 5:11-cv-00459D.
1—Complaint Filed by Pentair Water Pool & Spa, Inc. and Danfoss Drives A/S with respect to Civil Action No. 5:11-cv-00459-D; Aug. 31, 2011.
22—Memorandum in Support of Motion for Preliminary Injunction by Plaintiffs with respect to Civil Action 5:11-cv-00459-D; Sep. 2, 2011.
23—Declaration of E. Randolph Collins, Jr. In Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32—Answer to Complaint with Jury Demand & Counterclaim Against Plaintiffs by Hayward Pool Products & Hayward Industries for Civil Action 5:11-cv-00459D; Oct. 12, 2011.
45—Plaintiffs' Reply to Defendants' Answer to Complaint & Counterclaim for Civil Action 5:11-cv-00459D; Nov. 2, 2011.
50—Amended Answer to Complaint & Counterclaim by Defendants for Civil Action 5:11-cv-00459D; Nov. 23, 2011.
51—Response by Defendants in Opposition to Motion for Preliminary Injunction for Civil Action 5:11-cv-00459D; Dec. 2, 2011.
53—Declaration of Douglas C. Hopkins & Exhibits re Response Opposing Motion for Preliminary Injunction for Civil Action 5:11-cv-00459D; Dec. 2, 2011.
54DX16—Hayward EcoStar Technical Guide (Version2); 2011; pp. 1-51; cited in Civil Action 5:11-cv-00459D.
54DX17—Hayward ProLogic Automation & Chlorination Operation Manual (Rev. F); pp. 1-27; Elizabeth, NJ; cited in Civil Action 5:11-cv-00459D; Dec. 2, 2011.
54DX22—Danfoss; "VLT 8000 Aqua Instruction Manual;" pp. 1-35; cited in Civil Action 5:11-cv-00459D; Dec. 2, 2011.
7—Motion for Preliminary Injunction by Danfoss Drives NS & Pentair Water Pool & Spa, Inc. with respect to Civil Action No. 5:11-cv-00459-D; Sep. 30, 2011.
9PX10—Pentair; "IntelliPro VS+SVRS Intelligent Variable Speed Pump;" 2011; pp. 1-6; cited in Civil Action 5:11-cv-00459D.
9PX11—Pentair; "IntelliTouch Pool & Spa Control Control Systems;" 2011; pp. 1-5; cited in Civil Action 5:11-cv-00459D.
9PX14—Pentair; "IntelliFlo Installation and User's Guide;" pp. 1-53; Jul. 26, 2011; Sanford, NC; cited in Civil Action 5:11-cv-00459D.
9PX17—Hayward Pool Products; "EcoStar & EcoStar SVRS Brochure;" pp. 1-7; Elizabeth, NJ; cited in Civil Action 5:11-cv-00459D; Sep. 30, 2011.
9PX19—Hayward Pool Products; "Hayward Energy Solutions Brochure ;" pp. 1-3; www.haywardnet.com; cited in Civil Action 5:11-cv-00459D; Sep. 2011.
9PX20—Hayward Pool Products; "ProLogic Installation Manual (Rev. G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX23—Hayward Pool Products; Selected Pages from Hayward's Website:/www.hayward-pool.com; pp. 1-27; cited in Civil Action 5:11-cv-00459D; Sep. 2011.
9PX28—Hayward Pool Products; "Selected Page from Hayward's Website Relating to EcoStar Pumps;" p. 1; cited in Civil Action 5:11-cv-00459D; Sep. 2011.
9PX29—Hayward Pool Products; "Selected Page from Hayward's Website Relating to EcoStar SVRS Pumps;" cited in Civil Action 5:11-cv-00459; Sep. 2011.
9PX30—Hayward Pool Systems; "Selected Pages from Hayward's Website Relating to ProLogic Controllers;" pp. 1-5; Civil Action 5:11-cv-00459D; Sep. 2011.
9PX5—Pentair; Selected Website Pages; pp. 1-28; cited in Civil Action 5:11-cv-00459D; Sep. 2011.
9PX6—Pentair; "IntelliFlo Variable Speed Pump" Brochure; 2011; pp. 1-8; cited in Civil Action 5:11-cv-00459D.
9PX7—Pentair; "IntelliFlo VF Intelligent Variable Flow Pump;" 2011; pp. 1-8; cited in Civil Action 5:11-cv-00459D.
9PX8—Pentair; "IntelliFlo VS+SVRS Intelligent Variable Speed Pump;" 2011; pp. 1-8; cited in Civil Action 5:11-cv-00459D.
9PX9—STA-RITE; "IntelliPro Variable Speed Pump;" 2011; pp. 1-8; cited in Civil Action 5:11-cv-00459D.
PX-138—Deposition of Dr. Douglas C. Hopkins; pp. 1-391; 2011; taken in Civil Action 10-cv-1662.
PX-141—Danfoss; "Whitepaper Automatic Energy Optimization;" pp. 1-4; 2011; cited in Civil Action 5:11-cv-00459.
PX-34—Pentair; "IntelliTouch Pool & Spa Control System User's Guide" ; pp. 1-129; 2011; cited in Civil Action 5:11-cv-00459; 2011.
105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—Order Denying Motion for Preliminary Injunction for Civil Action 5:11-cv-00459D; Jan. 23, 2012.
123—Answer to Amended Complaint, Counterclaim Against Danfoss Drives NS, Pentair Water Pool & Spa, Inc. for Civil Action 5:11-cv-00459D; Jan. 27, 2012.
152—Order Denying Motion for Reconsideration for Civil Action 5:11-cv-00459D; Apr. 4, 2012.
168—Amended Motion to Stay Action Pending Reexamination of Asserted Patents by Defendants for Civil Action 5:11-cv-00459D; Jun. 13, 2012.
174—Notice and Attachments re Joint Claim Construction Statement for Civil Action 5:11-cv-00459D; Jun. 5, 2012.
186—Order Setting Hearings—Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for civil Action 5:11-cv-00459D; Jul. 2012.
205-24-Exh23—Plaintiff's Preliminary Disclosure of Asserted Claims and Preliminary Infringement Contentions; cited in civil Action 5:11-cv-00459; Feb. 21, 2012.
210—Order Granting Joint Motion for Leave to Enlarge Page Limit for Civil Action 5:11-cv-00459D; Jul. 2012.
218—Notice re Plaintiffs re Order on Motion for Leave to File Excess Pages re Amended Joint Claim Construction Statement for Civil Action 5:11-cv-00459D; Aug. 2012.
89—Reply to Response to Motion for Preliminary Injunction Filed by Danfoss Drives A/S & Pentair Water Pool & Spa, Inc. for Civil Action 5:11-cv-00459D; Jan. 3, 2012.
Docket Report for Case No. 5:11-cv-00459-D; Nov. 2012.
Bjarke Soerensen; "Have You Chatted With Your Pump Today?" Undated Article Reprinted with Permission of Grundfos Pump University; pp. 1-2; USA.
Goulds Pumps; "Balanced Flow Submersible System Informational Seminar;" pp. 1-22; before Nov. 1, 2012.
Goulds Pumps; "Balanced Flow System . . . The Future of Constant Pressure Has Arrived;" before Nov. 1, 2012.
Grundfos; "JetPaq—The Complete Pumping System;" before Nov. 1, 2012; pp. 1-4; Clovis, CA USA.
Grundfos; "SQ/SQE—A New Standard in Submersible Pumps;" before Nov. 1, 2012; pp. 1-14; Denmark.
Grundfos; "Uncomplicated Electronics . . . Advanced Design;" pp. 1-10; before Nov. 1, 2012.
"Constant Pressure is the Name of the Game;" Published Article from National Driller; Mar. 2001.
Texas Instruments, TMS320F/C240 DSP Controllers Reference Guide Peripheral Library and Specific Devices, Literature No. SPRU 161D (Nov. 2002).
54DX18—Stmicroelectronics; "AN1946—Sensorless BLDC Motor Control & BEMF Sampling Methods with ST7MC;" 2007; pp. 1-35; Civil Action 5:11-cv-0045911.

(56) References Cited

OTHER PUBLICATIONS

54DX30—Sabbagh et al; "A Model for Optimal . . . Control of Pumping Stations in Irrigation Systems;" Jul. 1988; NL pp. 119-133; Civil Action 5:11-cv-00459D.
Baldor; "Baldor Motors and Drives Series 14 Vector Drive Control Operating & Technical Manual;" Mar. 22, 1992; pp. 1-92.
54DX45—Hopkins; "Synthesis of New Class of Converters that Utilize Energy Recirculation;" pp. 1-6; cited in Civil Action 5:11-cv-00459D; 1994.
Texas Instruments, Digital Signal Processing Solution for AC Induction Motor, Application Note, BPRA043 (1996).
54DX34—Pentair; "Compool 3800 Pool-Spa Control System Installation & Operating Instructions;" Nov. 7, 1997; pp. 1-45; cited in Civil Action 5:11-cv-00459D.
Compool; "Compool CP3800 Pool-Spa Control System Installation and Operating Instructions;" Nov. 7, 1997; pp. 1-45.
Microchip Technology, Inc., PICMicro Mid-Range MCU Family Reference Manual (Dec. 1997).
Dinverter; "Dinverter 2B User Guide;" Nov. 1998; pp. 1-94.
Texas Instruments, Zhenyu Yu and David Figoli, DSP Digital Control System Applications—AC Induction Motor Control Using Constant V/Hz Principle and Space Vector PWM Technique with TMS320C240, Application Report No. SPRA284A (Apr. 1998).
"Understanding Constant Pressure Control;" pp. 1-3; Nov. 1, 1999.
54DX47—Hopkins; "Optimally Selecting Packaging Technologies . . . Cost & Performance;" pp. 1-8; cited in Civil Action 5:11-cv-00459D; Jun. 1999.
Grundfos Pumps Corporation; "Grundfos SQ/SQE Data Book;" pp. 1-39; Jun. 1999; Fresno, CA USA.
Grundfos Pumps Corporation; "The New Standard in Submersible Pumps;" Brochure; pp. 1-8; Jun. 1999; Fresno, CA USA.
"Water Pressure Problems" Published Article; The American Well Owner; No. 2, Jul. 2000.
54DX38—Danfoss; "VLT 6000 Series Installation, Operation & Maintenance Manual;" Mar. 2000; pp. 1-118; cited in Civil Action 5:11-cv-00459D.
Baldor; "Baldor Series 10 Inverter Control: Installation and Operating Manual" ; Feb. 2000; pp. 1-74.
Danfoss; "Danfoss VLT 6000 Series Adjustable Frequency Drive Installation, Operation and Maintenance Manual;" Mar. 2000; pp. 1-118.
F.E. Myers; "Featured Product: F.E. Myers Introducts Revolutionary Constant Pressure Water System;" pp. 1-8; Jun. 28, 2000; Ashland, OH USA.
Goulds Pumps; "Balanced Flow Submersible System Installation, Operation & Trouble-Shooting Manual;" pp. 1-9; 2000; USA.
Goulds Pumps; "Balanced Flow System Model BFSS Variable Speed Submersible Pump" Brochure; pp. 1-3; Jan. 2000; USA.
Goulds Pumps; "Balanced Flow System Variable Speed Submersible Pump" Specification Sheet; pp. 1-2; Jan. 2000; USA.
ST72141 Microcontroller; 2000; pp. 1-18; cited in Civil Action 5:11-cv-00459D.
Email Regarding Grundfos' Price Increases/SQ/SQE Curves; pp. 1-7; Dec. 19, 2001.
Franklin Electric; "CP Water-Subdrive 75 Constant Pressure Controller" Product Data Sheet; May 2001; Bluffton, IN USA.
Goulds Pumps; "Balanced Flow System Brochure;" pp. 1-4; 2001.
Goulds Pumps; "Balanced Flow System Model BFSS Variable Speed Submersible Pump System" Brochure; pp. 1-4; Jan. 2001; USA.
Goulds Pumps; "Hydro-Pro Water System Tank Installation, Operation & Maintenance Instructions;" pp. 1-30; Mar. 31, 2001; Seneca Falls, NY USA.
Goulds Pumps; "Model BFSS List Price Sheet;" Feb. 5, 2001.
Robert S. Carrow; "Electrician's Technical Reference-Variable Frequency Drives;" 2001; pp. 1-187.
"Product Focus—New AC Drive Series Targets Water, Wastewater Applications;" WaterWorld Articles; Jul. 2002; pp. 1-2.
54DX23—Commander; "Commander SE Advanced User Guide;" Nov. 2002; pp. 1-190; cited in Civil Action 5:11-cv-00459D.
54DX35—Pentair Advertisement in "Pool & Spa News;" Mar. 22, 2002; pp. 1-2; cited in Civil Action 5:11-cv-00459D.
54DX36—Hayward; "Pro-Series High-Rate Sand Filter Owner's Guide;" 2002; Elizabeth, NJ; pp. 1-4; cited in Civil Action 5:11-cv-00459D.
54DX37—Danfoss; "VLT 8000 Aqua Fact Sheet;" Jan. 2002; pp. 1-2.
54DX48—Hopkins; "Partitioning Digitally . . . Applications to Ballasts;" pp. 1-5; cited in Civil Action 5:11-cv-00459D; Mar. 2002.
Amtrol Inc.; "Amtrol Unearths the Facts About Variable Speed Pumps and Constant Pressure Valves;" pp. 1-5; Aug. 2002; West Warwick, RI USA.
Commander; "Commander SE Advanced User Guide;" Nov. 2002; pp. 1-118.
Franklin Electric; "Franklin Aid, Subdrive 75: You Made It Better;" vol. 20, No. 1; pp. 1-2; Jan./Feb. 2002; www.franklin-electric.com.
Goulds Pumps; Advertisement From "Pumps & Systems Magazine;" Jan. 2002; Seneca Falls, NY.
Goulds Pumps; "Pumpsmart Control Solutions" Advertisement from Industrial Equipment News; Aug. 2002; New York, NY USA.
Grundfos; "SmartFlo SQE Constant Pressure System;" Mar. 2002; pp. 1-4; Olathe, KS USA.
Hayward; "Hayward Pro-Series High-Rate Sand Filter Owner's Guide;" 2002; pp. 14.
Pentair; "Pentair RS-485 Pool Controller Adapter" Published Advertisement; Mar. 22, 2002; pp. 1-2.
54DX31—Danfoss; "VLT 5000 FLUX Aqua DeviceNet Instruction Manual;" Apr. 28, 2003; pp. 1-38; cited in Civil Action 5:11-cv-00459D.
54DX32—Danfoss; "VLT 5000 FLUX Aqua Profibus Operating Instructions;" May 22, 2003; 1-64; cited in Civil Action 5:11-cv-00459D.
54DX33—Pentair; "IntelliTouch Owner's Manual Set-Up & Programming;" May 22, 2003; Sanford, NC; pp. 1-61; cited in Civil Action 5:11-cv-00459D.
Franklin Electric; "Franklin Application Installation Data;" vol. 21, No. 5, Sep./Oct. 2003; pp. 1-2; www.franklin-electric.com.
Grundfos; "Grundfos SmartFlo SQE Constant Pressure System;" Mar. 2003; pp. 1-2; USA.
Pentair; "Pentair IntelliTouch Operating Manual;" May 22, 2003; pp. 1-60.

FLOW LOCKING SYSTEM AND METHOD

RELATED APPLICATIONS

This application is a continuation of U.S. patent application Ser. No. 13/666,852 filed on Nov. 1, 2012, which claims priority under 35 U.S.C. § 119 to U.S. Provisional Patent Application No. 61/554,439 filed on Nov. 1, 2011. The entire contents of each preceding application is incorporated herein by reference for all purposes.

BACKGROUND

Conventional pool pumps are operable at a finite number of predetermined speed settings. These speed settings correspond to the range of pumping demands of the pool at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings may not be readily changed to accommodate changes in the pool conditions and/or pumping demands. For example, flow rates through these pumps change over time because the system's total dynamic head changes as dirt and debris accumulate in the pool filter and strainers. This increase in flow resistance causes the conventional pumps to lose flow as the system gets dirty. Due to this loss of flow and the inability to adjust settings, such systems may not maintain desired turnover rates in the pool. As a result, such systems fail to meet health department requirements for commercial swimming pool applications, which require a minimum number of turnovers per day.

Newer pool pump systems include variable speed drives, allowing them to operate at any number of speeds to maintain the above-described factors independent of changes in the pool conditions and/or pumping demands. These pumps are controlled to run at different speeds and flows to maintain one or more control factors and to accommodate changing water supply needs of a pool, such as periodic operation of a water feature. Current control of such systems only focuses on a number of manual and/or scheduled operations, programmable by a pool user, and generally may not consider overall flow or turnover parameters.

SUMMARY

Some embodiments of the invention provide a pumping system for at least one aquatic application including a pump, a motor coupled to the pump, and a pump controller in communication with the motor. The pump controller includes a user interface configured to initially receive and set a maximum locked flow rate, a minimum locked flow rate, and a plurality of programmed flow rate settings including a first programmed flow rate setting. The pump controller is also configured to disable resetting of the maximum flow rate and the minimum flow rate once they are initially received and set through the user interface and to allow resetting of the plurality of programmed flow rate settings throughout operation of the pumping system. The pump controller is further configured to operate the motor in order to maintain a first flow rate through the pumping system set by the first programmed flow rate setting as long as the first flow rate is between the minimum locked flow rate and the maximum locked flow rate.

Some embodiments of the invention provide a method of operating a controller of a pump including motor for use with a pumping system. The method includes receiving a maximum flow rate and a minimum flow rate and locking the maximum flow rate and the minimum flow rate as permanent parameters of the pumping system. The method also includes receiving a first programmed flow rate setting including at least a first flow rate and receiving a second programmed flow rate setting including at least a second flow rate. The method further includes selecting one of the first flow rate and the second flow rate as a selected flow rate for current pump operation and operating the motor to maintain the selected flow rate as long as the selected flow rate is between the maximum flow rate and the minimum flow rate.

DETAILED DESCRIPTION

Figure 1:
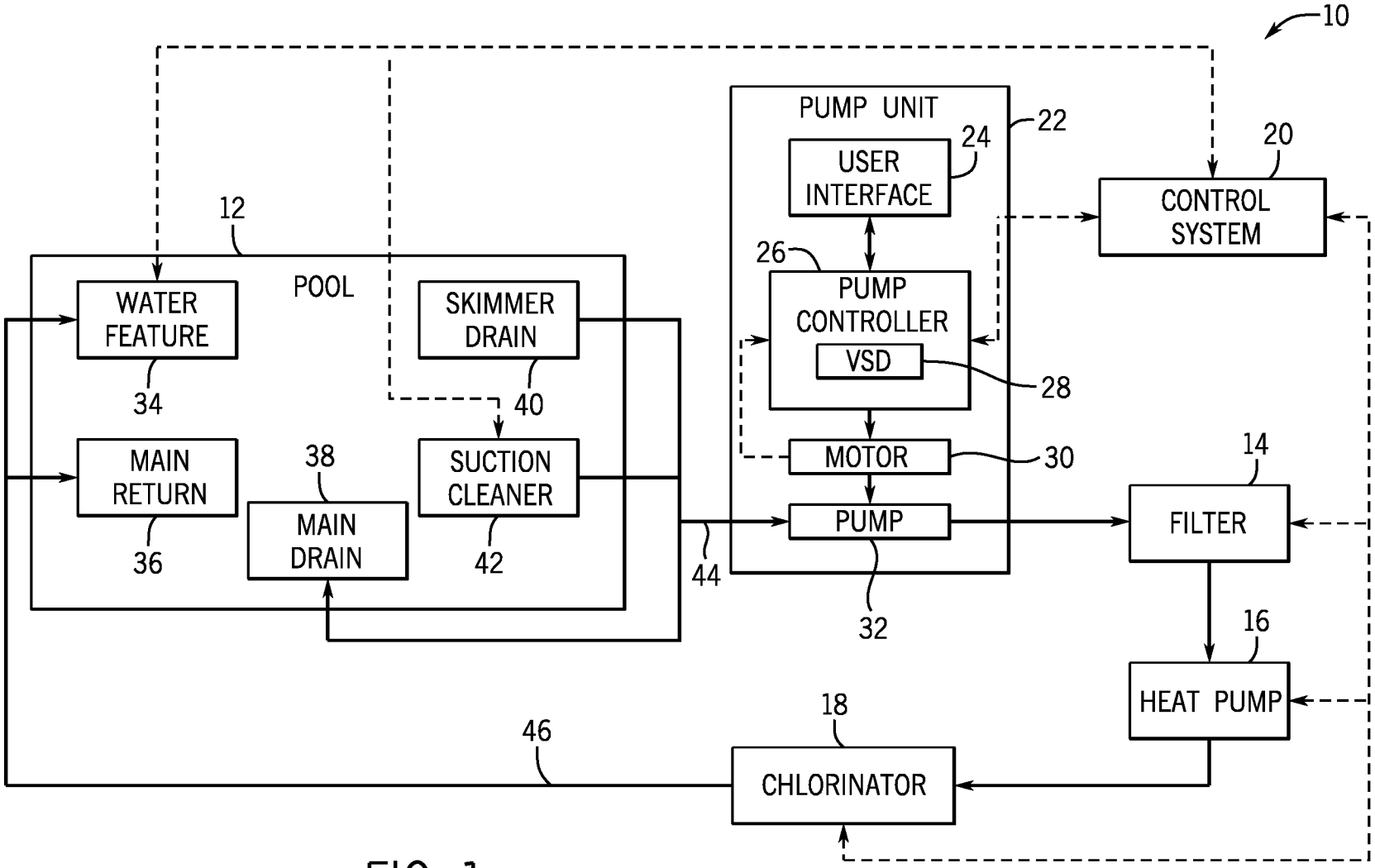
FIG. 1 is a block diagram of a variable speed pumping system in a pool environment in accordance with one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a schematic of a variable-speed pumping system 10, according to one embodiment of the invention, in connection with a pool 12. The pumping system 10 can include a filter 14, a heat pump 16, a chlorinator 18, a control/automation system 20, and a pump unit 22 with a user interface 24, a pump controller 26 including a variable speed drive (VSD) 28, a motor 30, and a pump 32. The pool 12 can be any aquatic application including, but not limited to, a commercial or residential swimming pool, spa, and/or whirlpool bath, and can include a water feature 34 including one or more waterfalls, spillways, etc., a main return 36 including one or more pool inlets, a main drain 38 including one or more drains, a skimmer drain 40, and/or a suction cleaner 42. The skimmer drain 40 can collect coarse debris from water being withdrawn from the pool 12 and the suction cleaner 42 can be a manual or automatic pool cleaner and can vacuum debris from various submerged surfaces of the pool 12.

Water can be circulated through the pool 12 by the pumping system 10 through an outlet line 44 connected to the water feature 34 and/or the main return 36 (e.g., supplying water to the pool 12) and an inlet line 46 connected to the skimmer drain 40, the suction cleaner 42, and/or the main drain 38 (e.g., receiving or withdrawing water from the pool 12). More specifically, as shown in FIG. 1, the pump 32 can move water from the inlet line 46 to the outlet line 44, and the filter 14, the heat pump 16, and the chlorinator 18 can be connected between the pump 32 and the outlet line 44 to treat the water before it is supplied back to the pool 12. As a result, the pool components receiving water (i.e., the skimmer drain 40, the suction cleaner 42, and/or the main drain 38), the pump 32, the filter 14, the heat pump 16, the chlorinator 18, and the pool components supplying water (i.e., the water feature 34 and/or the main return 38) form a fluid circuit or pathway, as designated by solid line connections in FIG. 1, for circulating water through the pool 12. In some embodiments, some pool components, such as the water feature 34 and/or the suction cleaner 42, are capable of being shut off manually or automatically so that they do not supply water to or receive water from the pool 12 (e.g., so that they are no longer part of the fluid circuit). In addition, in some embodiments, components such as the heat pump 16 and/or the chlorinator 18 may not be included within the pumping system 10 and the fluid circuit.

Components of the pumping system 10 can be connected through fluid connections (i.e., designated by solid lines in FIG. 1), and/or mechanical or electrical connections (i.e., designated by dashed lines in FIG. 1). With respect to the pump unit 22, the pump 32 can be a centrifugal pump and can be driven by the pump motor 30, such as a permanent magnet motor, an induction motor, a synchronous motor, or an asynchronous motor. The pump motor operation can be infinitely variable within a range of operations (i.e., zero to maximum operation). In the case of a synchronous motor 30, the steady state speed of the motor 30 (in rotations per minute, or RPM) can be referred to as the synchronous speed. Further, in the case of a synchronous motor 30, the steady state speed of the motor 30 can also be determined based upon the operating frequency in hertz (Hz). The pump controller 26 can control the pump motor 30 and thus control the pump 32. The pump controller 26 can include the variable speed drive 28, which can provide infinitely variable control of the pump motor 30 (i.e., can vary the speed of the pump motor 30). Regarding operation of the variable speed drive 28, a single phase AC current from a source power supply can be converted into a three-phase AC current. The variable speed drive 28 can supply the three-phase AC electric power at a changeable frequency to the pump motor 30 in order to drive the pump motor 30. For example, the pump controller 26 and the variable speed drive 28 can operate the motor 30 as described in U.S. Pat. No. 7,857,600, entitled "Pump Controller System and Method," the entire contents of which are incorporated herein by reference.

The pump controller 26 can receive input from a user interface 24 in communication with the pump controller 26 (e.g., through physical or wireless connections). In addition, the pump controller 26 can be coupled to, such as physically attached or connected to, the pump 32 and/or the motor 30. In some embodiments, the pump controller 26 can control the pump 32 based on input from the user interface 24 as well as input or feedback from the motor 30. More specifically, the pump controller can monitor one or more performance values or characteristics of the pumping system 10 based on input from the motor 30 and can control the motor 30, and thus the pump 32, based on the monitored values or characteristics, thereby providing a feedback loop for controlling the motor 30. Various parameters (e.g., that are calculated, provided via a look-up table, graph or curve, such as a constant flow curve, etc.) can be used to determine the performance characteristics, such as input power consumed by the motor 30, motor speed, flow rate and/or flow pressure.

For example, in some embodiments, physical sensors are not used to sense the pressure and/or flow rate in the pumping system 10. Rather, motor power consumption (e.g., current draw) is used to monitor the performance of the motor 30 and the pump 32. Since the power consumption of the motor 30 has a relationship to the flow rate and pressure through the pump 32, pressure and/or flow rate can be calculated or determined allowing sensor-less control of the motor 30 and the pump 32. In other words, motor power consumption can be used to determine flow rate or pressure instead of using flow rate sensors or pressure sensors in locations throughout the pumping system 10. In addition, in some embodiments, the pump controller 26 can repeatedly monitor the motor 30 (such as the input power consumed by or the speed of the motor 30) to sense or determine an obstruction within the fluid circuit (e.g., along the inlet line upstream from the pump or along the outlet line downstream from the pump). For example, with respect to monitoring the motor 30 to sense or determine an obstruction, the pump controller 26 can operate in accordance with that described in U.S. Pat. No. 8,313,306 (entitled "Method of Operating a Safety Vacuum Release System") and United States Patent Publication No. 2007/0183902 (entitled "Anti-Entrapment and Anti-Dead Head Function"), the entire contents of which are incorporated herein by reference.

The pump controller 26 can also be connected to the control/automation system 20, for example in a manner to enable two-way communication between the pump controller 26 and the control/automation system 20. The control/automation system 20 can be an analog or digital control system that can include programmable logic controllers (PLC), computer programs, or the like that are pre-configured for controlling the pump 32. In some embodiments, the pump controller 26 and the control/automation system 20 can operate according to a master/slave relationship. For example, when the pump controller 26 is not connected to the control/automation system 20, the pump controller 26 can automatically control all functions of the pump unit 22. However when the control/automation system 20 is connected to the pump controller 26, the control/automation system 20 can automatically operate as a master controller and the pump controller 26 can automatically operate as a slave controller. In this manner, the master controller (i.e., the control/automation system 20) can have control over certain functions of the slave controller (i.e., the pump controller 26), such as functions related to optimization of energy consumption of the motor 30. As a result, the master controller can control the slave controller to operate the pump motor 30 and the pump 32 in a way to optimize energy consumption of the motor 30 or perform other operations specified by the user.

Figure 2:
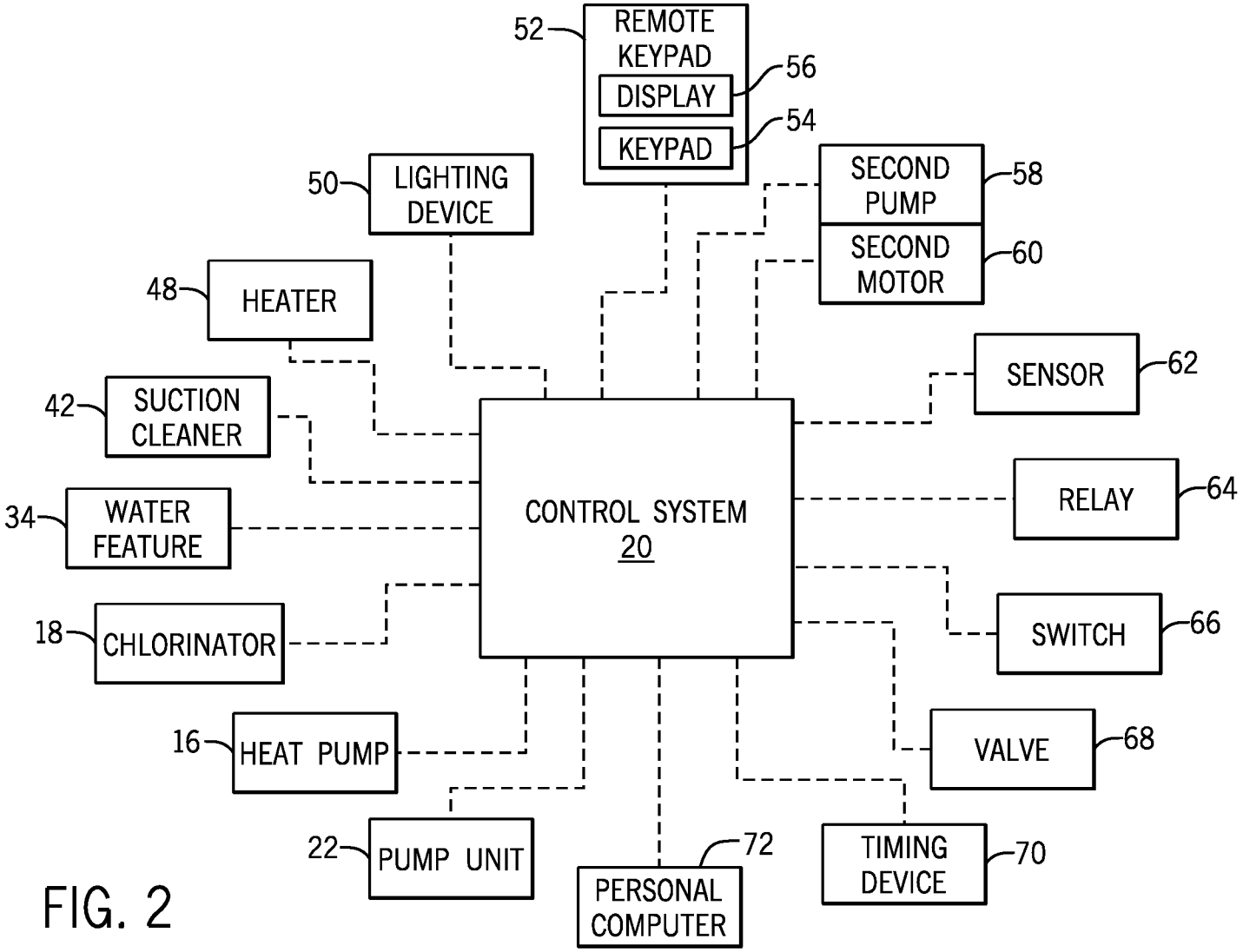
FIG. 2 is a schematic illustration of example auxiliary devices that can be operably connected to a control/automation system of the variable speed pumping system of FIG. 1.

In some embodiments, the control/automation system 20 can be operably connected to or in communication with one or more auxiliary devices in order to operate the auxiliary devices and/or receive input or feedback from the auxiliary devices. As shown in FIGS. 1 and 2, the auxiliary devices can include various mechanical, electrical, and/or chemical devices including, but not limited to, the pump unit 22 (e.g., via the pump controller 26, as described above), the filter 14, the heat pump 16, the chlorinator 18 and/or another chemical dispersion device (not shown), the water feature 34, the suction cleaner 42, a water heater 48, one or more lighting devices 50, a remote keypad 52 (e.g., including a user interface, such as a keypad 54, buttons, touch screen, etc., for receiving user input and/or a display 56), a second pump 58 and/or a second pump motor 60, one or more sensors 62 associated with the pool 12 or the pumping system 10, one or more electrical or mechanical relays 64 or switches 66 associated with the pool 12 or the pumping system 10, one or more electrically or mechanically operated water valves 68 associated with the pool 12 or the pumping system 10, an electrical or mechanical timing device 70, and/or a personal computer 72. Connections between the control/automation system 20 and the auxiliary devices can be wired or wireless and can enable two-way communication between the control/automation system 20 and the auxiliary devices. For example, the remote keypad 54 can be a wireless keypad positioned away from the control/automation system 20 and/or the pump controller 26. In another example, the personal computer 72 can be connected to the control/automation system 20 through a wired or wireless computer network, such as a local area network. In addition, in some embodiments, one or more of the auxiliary devices can be connected to the pump controller 26 rather than the control/automation system 20, for example through a communications panel or junction box (not shown).

Two-way communication between the control/automation system 20 and the auxiliary devices (or the pump controller 26 and the auxiliary devices) can allow for control of the motor 30, and thus the pump 32, based on input or feedback from the auxiliary devices. More specifically, inputs from the auxiliary devices, such as a desired flow rate necessary for operation of the water heater 48, a user input from the remote keypad 52, etc., can be used to control operation of the motor 30 and the pump 32. Other parameters used by the control/automation system 20 (and/or the pump controller 26) for controlling operation of the pump motor 30 and the pump 32 can include, but are not limited to, water flow rate, water pressure, motor speed, and power consumption, as discussed above, as well as filter loading, chemical levels, water temperature, alarms, operational states, time, energy cost, turnovers per day, relay or switch positions, and/or other parameters (e.g., sensed, determined, calculated, obtained, etc.) that indicate performance of the pumping system 10.

In a general example, information entered into the remote keypad 52 by a user can be received by the control/automation system 20, and the control/automation system 20 (i.e., acting as the master controller) can control the pump controller 26 (i.e., acting as the slave controller) to operate the motor 30 and the pump 32 based on the input information. The control/automation system 20 can also provide information back to the remote keypad 52 to display to the user, for example via the display 56. In a more specific example with respect to turnovers per day, the pumping system 10 (i.e., the control/automation system 20 and/or the pump controller 26) can be preconfigured to permit a user to input, via the user interface 24 or the remote keypad 52, a desired number of turnovers (i.e., number of times water is re-circulated through the fluid circuit). The control/automation system 20 and/or the pump controller 26 can then operate the motor 30 and the pump 32 to perform the desired number of turnovers within a predetermined amount of time, such as a 24-hour period. In another example, the control/automation system 20 can receive information from one or more auxiliary devices that the water heater 48 is operating or needs to operate, and can alter the performance of the pumping system 10 (e.g., alter a speed of the pump motor 30) to provide an increased flow rate necessary for proper operation of the water heater 48.

Figure 3:
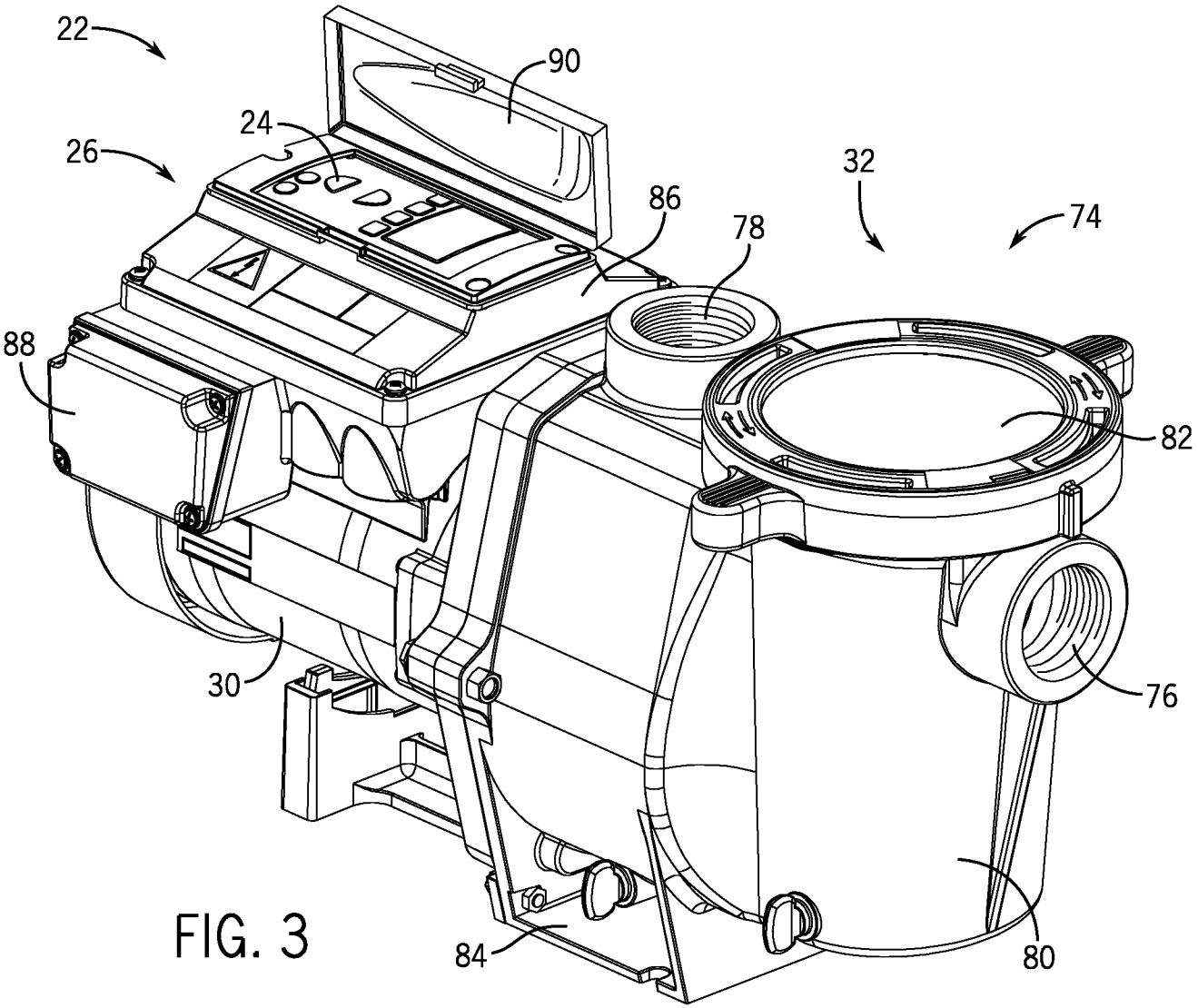
FIG. 3 is a perspective view of a pool pump for use in one embodiment of the invention.
Figure 4:
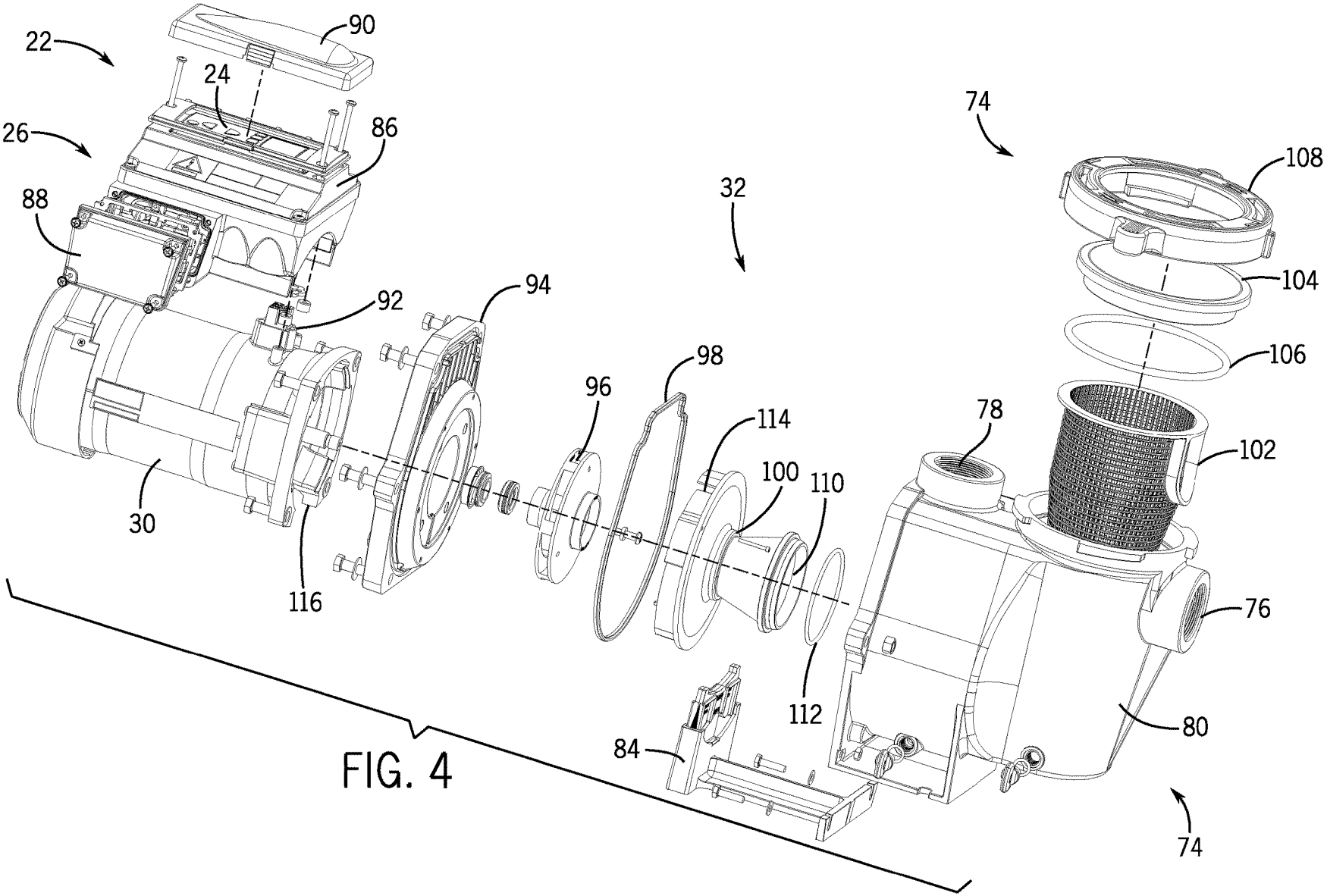
FIG. 4 is an exploded perspective view of the pool pump of FIG. 3.

FIGS. 3 and 4 illustrate the pump unit 22, according to one embodiment of the invention, including the pump 32, the pump controller 26, the user interface 24, and the motor 32 for use with the pumping system 10 described above. The pump 32 can be configured for use in any suitable aquatic application, including pools, spas, and/or water features. The pump 32 can include a housing 74 and can be connected to the motor 30. In some embodiments, the motor 30 can be a variable speed motor, as described above, and the pump controller 26 can include a variable speed drive to drive the motor 30. In one embodiment, the motor 30 can be driven at four or more different pre-set speeds. The housing 74 can include an inlet 76, an outlet 78, a basket 80, a lid 82, and a stand 84. The stand 84 can support the motor 30 and can be used to mount the pump 32 on a suitable surface (not shown).

In some embodiments, the pump controller 26 can be coupled to (e.g., physically attached or fastened to) the pump 32 and/or the motor 30. For example, as shown in FIGS. 3 and 4, the pump controller 26 and the user interface 24 can be enclosed in a case 86 that can be mounted on the motor 30. The case 86 can include a field wiring compartment 88 and a cover 90. The cover 90 can be opened and closed to allow access to the pump controller 26 (and specifically, the user interface 24) and protect it from moisture, dust, and other environmental influences. In some embodiments, the field wiring compartment 88 can include a power supply to provide power to the motor 30 and the pump controller 26. In addition, the motor 30 can include a coupling 92, as shown in FIG. 4, to connect to the pump controller 26. In other embodiments, the pump controller 26 and/or the user interface 24 can be removable from the motor 30 and/or the pump 32. For example, in such embodiments, the pump controller 26 and/or the user interface 24 can be configured for mounting to the motor 30, the pump 32, and/or a wall and can be removable so that the pump controller 26 and/or the user interface 24 can be removed and remounted the motor 30, the pump 32, and/or a wall if desired by a user.

As shown in FIG. 4, the pump 32 can include a seal plate 94, an impeller 96, a gasket 98, a diffuser 100, and a strainer 102. The strainer 102 can be inserted into the basket 80 and can be secured by the lid 82. In some embodiments, the lid 82 can include a cap 104, an O-ring 106, and a nut 108. The cap 104 and the O-ring 106 can be coupled to the basket 80 by screwing the nut 108 onto the basket 80. The O-ring 106 can seal the connection between the basket 80 and the lid 82. An inlet 110 of the diffuser 100 can be fluidly sealed to the basket 80 with a seal 112. In some embodiments, the diffuser 100 can enclose the impeller 96. An outlet 114 of the diffuser 100 can be fluidly sealed to the seal plate 94. The seal plate 94 can be sealed to the housing 74 with the gasket 98. The motor 30 can include a shaft 116, which can be coupled to the impeller 96. The motor 30 can rotate the impeller 96, drawing fluid from the inlet 46 through the strainer 72 and the diffuser 70 to the outlet 48 (i.e., to drive the pump 32). With respect to the pumping system 10 of FIG. 1, the inlet 76 and the outlet 78 of the pump 32 can be connected to the inlet line 46 and the outlet line 44, respectively, of the pumping system 10.

Figure 5B:
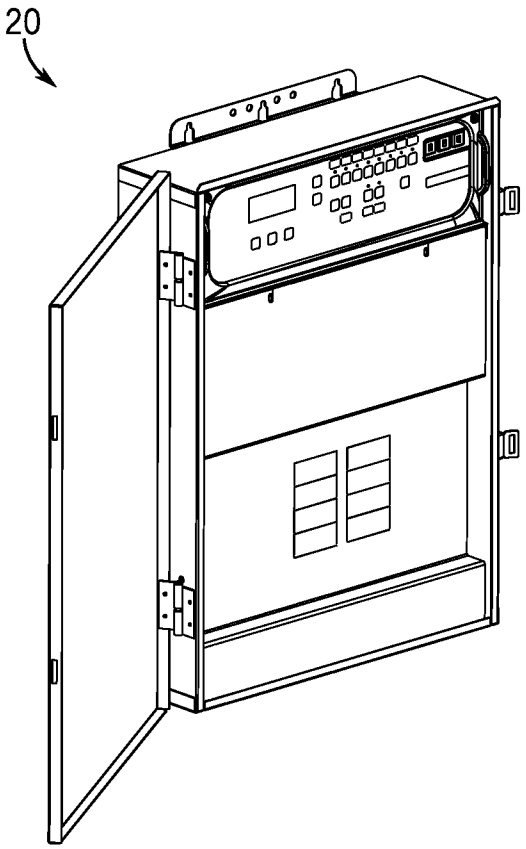
FIG. 5B is a perspective view of a control/automation system for use with the variable speed pumping system of FIG. 1.
Figure 5A:
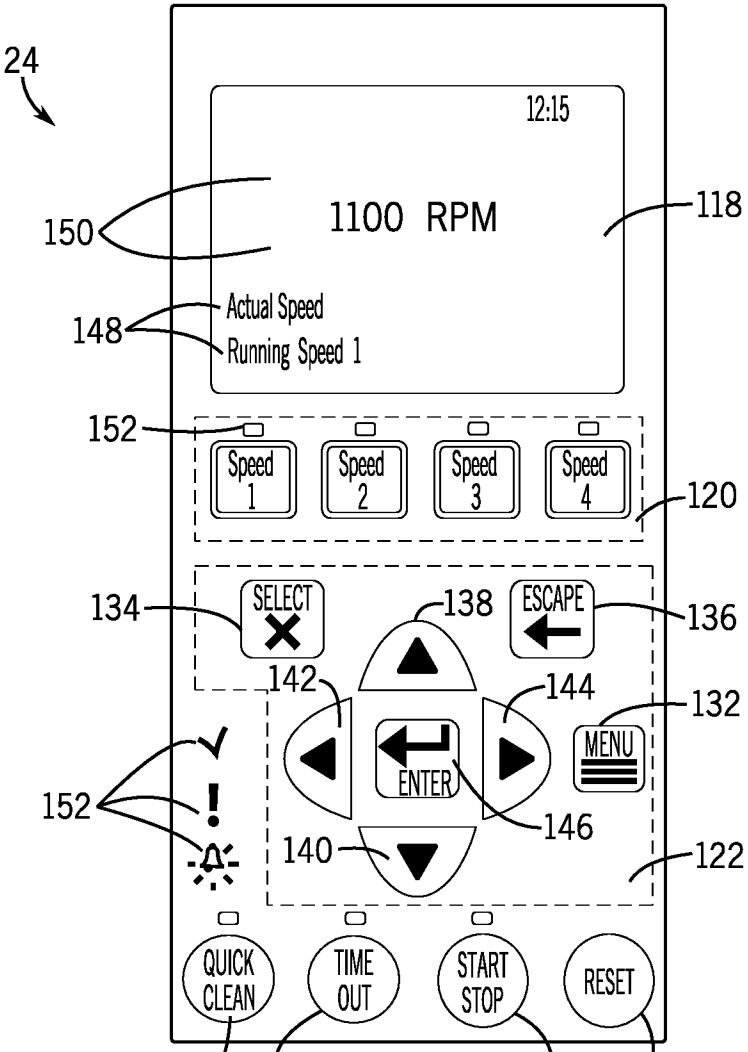
FIG. 5A is a front view of a user interface of a pump controller for use with the pool pump of FIG. 1.

FIG. 5A illustrates the user interface 24 for the pump controller 26 in accordance with one embodiment of the invention. The user interface 24 can include a display 118, at least one speed button 120, navigation buttons 122, a start-stop button 124, a reset button 126, a manual override button 128, and a "quick clean" button 130. The manual override button 128 can also be considered a "time out" button. In some embodiments, the navigation buttons 122 can include a menu button 132, a select button 134, an escape button 136, an up-arrow button 138, a down-arrow button 140, a left-arrow button 142, a right-arrow button 144, and an enter button 146. The navigation buttons 122 and the speed buttons 120 can be used to program a schedule into the pump controller 26. In some embodiments, for example, the display 108 can include a lower section 148 to display information about a parameter and an upper section 150 to display a value associated with that parameter. In some embodiments, the user interface 24 can include light emitting diodes (LEDs) 152 to indicate normal operation and/or a detected error of the pump 32.

FIG. 5B illustrates the control/automation system 20 according to one embodiment of the invention. As discussed above, the control/automation system 20 can communicate with the pump controller 26. Furthermore, as discussed above, the control/automation system 20 can control the pump 32 through a master/slave relationship with the pump controller 26. The control/automation system 20 can also be used to program the pump controller 26, for example, if the pump 32 is installed in a location where the user interface 24 is not conveniently accessible.

In some embodiments, generally, the pump controller 26 can automatically operate the pump 32 according to at least one programmed schedule (for example, designating a speed or flow rate of the pump 32 and/or the motor 30 as well as a scheduled start time, a scheduled stop time, and/or a duration). If two or more schedules are programmed into the pump controller 26, the schedule running the pump 32 at the highest speed can have priority over the remaining schedules. In some embodiments, the pump controller 26 can allow manual operation of the pump 32. If the pump 32 is manually operated and is overlapping a scheduled run, the scheduled run can have priority over the manual operation independent of the speed of the pump 32. In some embodiments, the pump controller 26 can include a manual override (e.g., through the manual override or "time out" button 128). The manual override can interrupt the scheduled and/or manual operation of the pump 32 to allow for cleaning and maintenance procedures of the pool 12 for example. Furthermore, in some embodiments, the pump controller 26 can monitor the operation of the pump 32 and can indicate abnormal conditions of the pump 32 and/or the pumping system 10, as discussed above.

Figure 6A:
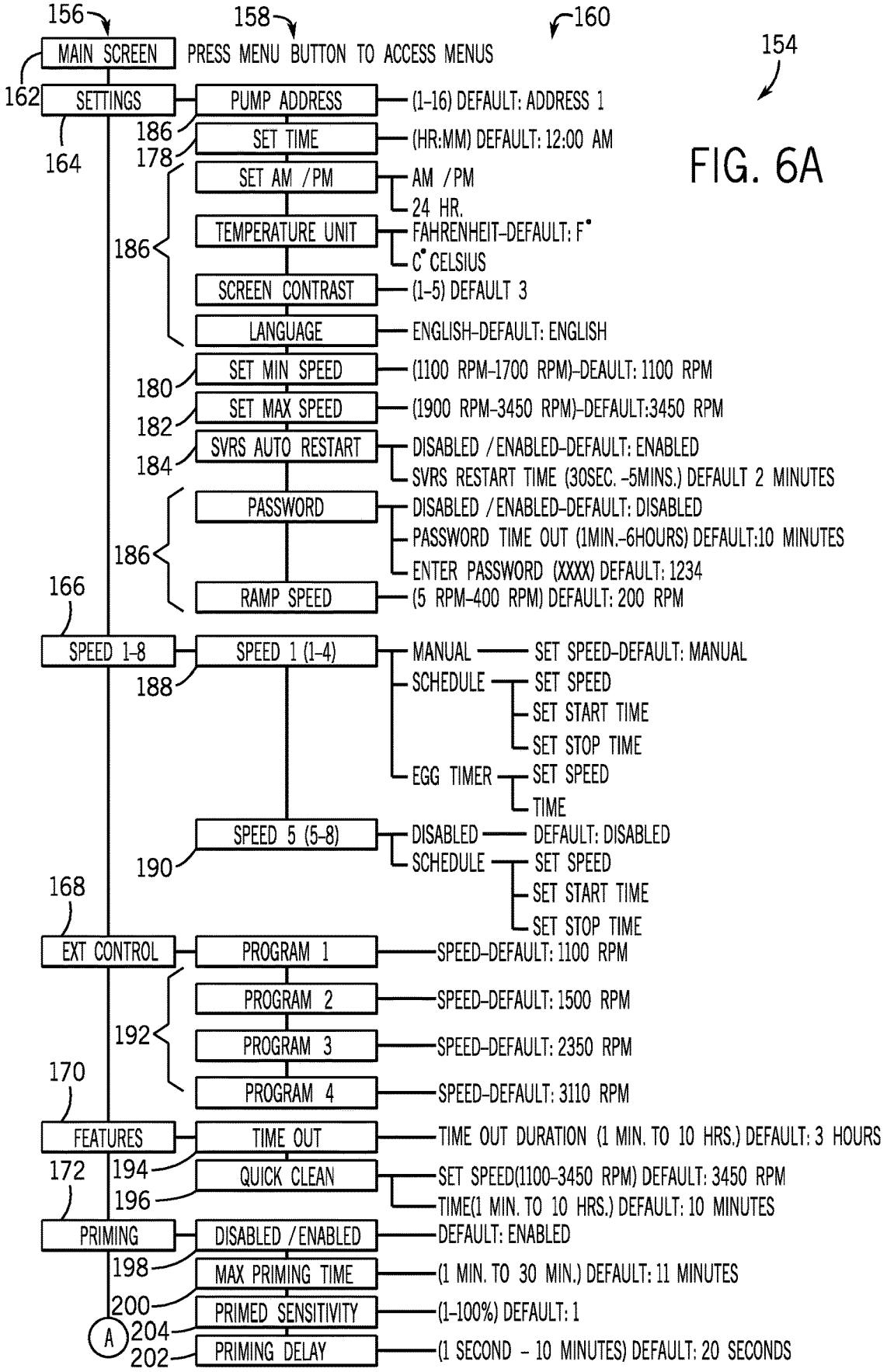
FIGS. 6A-6B illustrate a flow chart of menu settings of the pump controller of FIG. 5A according to one embodiment of the invention.
Figure 6B:
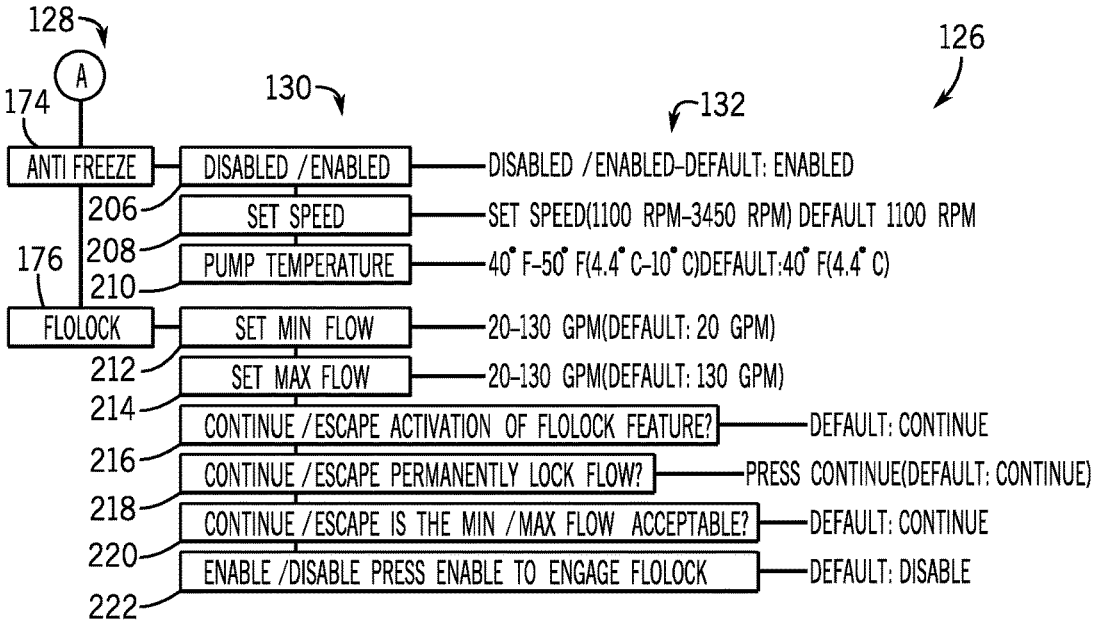

More specifically, FIGS. 6A-6B illustrate a menu 154 for the pump controller 26 according to one embodiment of the invention. In some embodiments, the menu 154 can be used to program various features of the pump controller 26. For example, the menu 154 can include a hierarchy of categories 156, parameters 158, and values 160, any one of which can be displayed by the display 118 of the user interface 24 so that a user or installer can program the various features on the pump controller 26. For example, from a main screen 162 on the display 118, an operator can enter the menu 154 by pressing the menu button 132. The operator can scroll through the categories 156 (i.e., so that the display visually scrolls through the menu 154) using the up-arrow button 138 and the down-arrow button 140. In some embodiments, the categories 156 can include settings 164, speed 166, external control 168, features 170, priming 172, anti freeze 174, and flow lock 176 (in any order). In some embodiments, the operator can enter a category 156 by pressing the select button 134. The operator can scroll through the parameters 158 within a specific category 156 using the up-arrow button 138 and the down-arrow button 140. The operator can select a parameter 158 by pressing the select button 134 and can adjust the value 160 of the parameter 158 with the up-arrow button 138 and/or the down-arrow button 140. In some embodiments, the value 160 can be adjusted by a specific increment or the user can select from a list of options. The user can save the value 160 by pressing the enter button 146. By pressing the escape button 136, the user can exit the menu 154 without saving any changes.

In some embodiments, the settings category 164 can include a time setting 178, a minimum speed setting 180, a maximum speed setting 182, and a SVRS automatic restart setting 184, as well as other settings parameters 186. The time setting 178 can be used to run the pump 32 on a particular schedule. The minimum speed setting 180 and the maximum speed setting 182 can be adjusted according to the volume of the aquatic applications. An installer of the pump 32 can provide the minimum speed setting 180 and the maximum speed setting 182, for example, upon installation of the pump 32. The pump controller 26 can automatically prevent the minimum speed setting 180 from being higher than the maximum speed setting 182. The minimum and maximum speed settings 180, 182 can be set so that the pump 32 will not operate outside of these speeds in order to protect flow-dependent devices with minimum speeds and pressure-sensitive devices (e.g., filters) with maximum speeds. The SVRS automatic restart setting 184 can provide a time period before the pump controller 26 will resume normal operation of the pump 32 after an obstruction along the inlet line 46 (for example, at the main drain 38) has been detected and the pump 32 has been stopped, in accordance with a safety vacuum release system feature of the pumping system 10. In some embodiments, there can be two minimum speed settings, such as one for dead head detection (e.g., a higher speed) and one for dynamic detection (e.g., a lower speed), as described in U.S. Pat. No. 8,313,306 (entitled "Method of Operating a Safety Vacuum Release System").

In some embodiments, the speed category 166 can be used to input data for running/operating the pump 32 manually and/or automatically (i.e., via programmed speed settings). In some embodiments, the pump controller 26 can store a number of pre-set speeds/speed settings (such as eight). In this example, each of the first four speeds/speed settings in a first set of speeds 188 ("Speed 1-4") can be set as manual speeds, scheduled speeds (e.g., speeds with set start and stop times), and/or countdown/timer speeds (e.g., speeds with a time duration). Each of the second four speeds/speed settings in a second set of speeds 190 ("Speed 5-8") can be set scheduled speeds (e.g., speeds with set start and stop times). As a result, speeds 5-8 can be programmed to operate in a scheduled mode only, while speeds 1-4 can be programmed to operate in a manual, scheduled, or countdown mode. In some embodiments, for the manual mode, only a speed can be programmed. For the scheduled modes, a speed, a start time, and a stop time can be programmed. For the countdown timer mode, a speed and a duration can be programmed. Thus, each speed setting can include a speed, a start time, a stop time, and/or a duration depending on the respective mode.

In some embodiments, the speeds/speed settings from both sets 188, 190 can be programmed into the pump controller 26 using the up-arrow button 138, the down-arrow button 140, and the enter button 146 to select the above-described values. Once programmed, the first set of speeds 188 (speeds 1-4) can be accessed by pressing one of the speed buttons 120 on the user interface 24. As discussed above, if two or more schedules are programmed into the pump controller 26 for the same time, the schedule running the pump 32 at the highest speed can have priority over the remaining schedules. Not all of speeds 5-8 in the second set of speeds 162 must be programmed to run on a schedule. For example, one or more of speeds 5-8 can be disabled.

The external control category 168 can include various programs 192 with speed settings that can run when commanded by the control/automation system 20. In the example shown, four programmed speeds can be included (i.e., programs 1-4). In one embodiment, these four programmed speeds can default at 1100 RPM, 1500 RPM, 2350 RPM, and 3110 RPM, respectively. Each program 192 can be accessible to individually set a new speed using the up-arrow button 138, the down-arrow button 140, and the enter button 146. In other embodiments, the number of programs 192 can be equal to the number of scheduled runs programmed in the second set of speeds 190 (speeds 5-8).

In addition, in some embodiments, the speed category 166 and the external control category 168 can alternatively be programmed with flow rates/flow rate settings instead of speeds/speed settings. For example, the speed category 166 can have an additional mode parameter that allows a user to select a "flow control mode" (i.e., where flow rates are set) or a "speed control mode" (i.e., where speeds are set, as described above). In the flow control mode, flow rates can be set in accordance with the speed settings described above (e.g., where speeds 1-4, speeds 5-8, and/or externally controlled programmed speeds of the programs 192 are instead flows 1-4, flows 5-8, and/or externally controlled programmed flows of the programs 192). Flows 1-4 can be programmed to operate in a manual, scheduled, or countdown mode, flows 5-8 can be programmed to operate in a scheduled mode, and the externally controlled programmed flows can be programmed to operate in a scheduled mode. Thus, each flow rate setting can include a flow rate, a start time, a stop time, and/or a duration depending on the respective mode. Flows 1-4 can also be accessed or selected through the navigation buttons 92 on the user interface 88. Accordingly, the pumping system 10, and in particular the pump controller 26, can operate to maintain a constant pump speed (i.e., in the speed control mode) and/or can operate to maintain a constant flow rate of water within the fluid circuit, or across the filter 14 (i.e., in the flow control mode).

Furthermore, in the flow control mode, the pump controller 26 continuously or periodically adjusts the speed of the motor 30 in order to maintain the set flow rates/flow rate settings. More specifically, the amount of water that can be moved and/or the ease by which the water can be moved is dependent in part upon the current state (e.g., quality, cleanliness) of the filter 14. In general, a clean (e.g., new, fresh, or backwashed) filter 14 provides a lesser impediment to water flow than a filter that has accumulated filter matter (e.g., a dirty filter 14). Therefore, for a constant flow rate through a filter 14, a lesser pressure is required to move the water through a clean filter 14 than a pressure that is required to move the water through a dirty filter 14. Another way of considering the effect of dirt accumulation is that if pressure is kept constant, the flow rate will decrease as the dirt accumulates and hinders (e.g., progressively blocks) the flow. Maintenance of a constant flow volume despite an increasing impediment caused by filter dirt accumulation can require an increasing pressure and is the result of increasing force from the pump motor 30. Some embodiments of the invention control the pump 32, and more specifically control the speed of the pump motor 30, to provide the increased force that provides the increased pressure to maintain the constant flow.

For example, as discussed above, the pump controller 26 can determine flow rates based on power consumption of the motor and/or the speed of the motor. Thus, in order to operate the pump 32 at a programmed flow rate, the pump controller 26 can execute one of the following flow control procedures. First, the pump controller 26 can determine (e.g., receive, obtain, or calculate) a current speed of the motor 30, determine a reference power consumption based on the current speed of the motor 30 and the programmed flow rate, and determine (e.g., receive, obtain, or calculate) the current power consumption of the motor 30. The pump controller 26 can then calculate a difference value between the reference power consumption and the current power consumption and use proportional (P), integral (I), and/or derivative (D) control (e.g., P, I, PI, PD, PID) based on the difference value to generate a new speed of the motor 30 that will achieve the programmed flow rate. The pump controller 26 can then adjust the current speed of the motor 30 to the new speed to maintain the programmed flow rate. Alternatively, the pump controller 26 can determine (e.g., receive, obtain, or calculate) a current speed of the motor 30, the current power consumption of the motor 30, and the current flow rate through the pumping system 10 (i.e., based on the current power consumption and/or the current speed). The pump controller 26 can then calculate a difference value between the reference power consumption and the current power consumption and use proportional, integral, and/or derivative control based on the difference value to generate a new speed of the motor 30 that will achieve the programmed flow rate. The pump controller 26 can then adjust the current speed of the motor 30 to the new speed to maintain the programmed flow rate. In some embodiments, the pump controller 26 can execute the flow control procedures as described in U.S. Pat. No. 7,845,913, entitled "Flow Control," the entire contents of which are incorporated herein by reference.

The ability to maintain a constant flow is useful to achieve a specific flow volume during a period of time. For example, as discussed above, it may be desirable to perform a specific number of turnovers within a predetermined time period, such as one day. The desired number of turnovers may be related to the necessity to maintain a desired water clarity, despite the fact that the filter of the pumping system will progressively increase dirt accumulation. Conversely, in existing single speed pumps, flow rates change over time because the resistance, or total dynamic head (TDH), of the pumping system changes as dirt and debris accumulate in the filter and system strainers. This increase in flow resistance causes the conventional single speed pump to lose flow as the system gets dirty, enough so that desired turnovers are not achieved as a result of the loss of flow.

Referring back to FIG. 6A, the features category 170 can be used to program a manual override. In some embodiments, the parameters can include a "time out" program 194 and a "quick clean" program 196. The "time out" program 194 can interrupt the operation of the pump 32 and/or motor 30 for a certain amount of time, which can be programmed into the pump controller 26. The "time out" program 194 can be selected by pressing the "time out" button 128 on the user interface 24. The "time out" program 194 can be used to stop operation of the pump 32 so that a user can clean the pool or spa and/or to perform maintenance procedures. The "quick clean" program 196 can include a speed setting and a duration setting. The "quick clean" program 196 can be selected by pressing the "quick clean" button 130 located on the user interface 24. When pressed, the "quick clean" program 196 can have priority over the scheduled and/or manual operation of the pump 32. After the pump 32 has been operated for the time period of the duration setting, the pump 32 can resume to the scheduled and/or manual operation. If the SVRS has been previously triggered and the time period for the SVRS automatic restart 184 has not yet elapsed, the "quick clean" program 196 may not be initiated by the pump controller 26.

In the priming category 172, the priming of the pump 32 can be enabled or disabled at setting 200. The priming sequence of the pump 32 can remove substantially all air in the pump 32 in order to allow water to flow through the pump 32 and/or the fluid circuit. If priming is enabled, a maximum duration for the priming sequence ("max priming time") can be programmed into the pump controller 26 at setting 202. This is the maximum duration that the pump 32 will try to prime before giving an error. In some embodiments, the priming sequence can be run/driven at the maximum speed 182. In another example, the pump 32 can be run at a first speed (e.g., 1800 RPM) for a first duration (e.g., about three seconds). If there is sufficient flow through the pump 32, priming is completed. If not, the pump 32 can be run at the maximum speed 182 for a priming delay time (such as about 20 seconds, set at setting 204). If there is sufficient flow through the pump 32 at this point, priming is completed. If not, the pump 32 can continue to be run at the maximum speed 182 for an amount of time set by the maximum priming time setting 202. If there is still not sufficient flow when the maximum priming time setting 202 has expired, a dry priming alarm can be reported (e.g., via the LEDs 152 and/or the display 118). In addition, a priming sensitivity value from 1% to 100% can be selected at setting 206. This priming sensitivity value affects the determination of whether flow is sufficient to consider priming completed. Lower sensitivity values increase the amount of flow needed for the pump 32 to sense that it is primed, while higher sensitivity values decrease the amount of flow needed for the pump 32 to sense that it is primed.

In some embodiments, an internal temperature sensor of the pump 32 can be connected to the pump controller 26 in order to provide an anti-freeze operation for the pumping system 10 and the pump 32. In the anti-freeze category 174, an enable/disable setting 208 can be set to enable or disable the anti-freeze operation. Furthermore, a speed setting 210 and a temperature setting 212 at which the pump 32 can be activated to prevent water from freezing in the pumping system can be programmed into the pump controller 26. If the temperature sensor detects a temperature lower than the temperature setting 212, the pump 32 can be operated according to the speed setting 210. In some embodiments, the internal temperature sensor can sense a temperature of the motor 30 and/or the variable speed drive of the pump controller 26. For example, the internal temperature sensor can be embedded within a heat sink positioned between the pump controller/variable speed drive and the motor 30.

As shown in FIG. 6B, the menu 154 can include the flow lock category 176 for the pump 32 to operate with a flow locking feature. Generally, this flow locking feature can allow a user to program a minimum and maximum flow rate into the pumping system 10 that cannot be changed, thereby "locking the flow." In some embodiments, this feature can be active when the pump 32 and the motor 30 are being controlled in the speed control mode in accordance with the speed settings described above (e.g., the first set of speeds 160, the second set of speeds 162, or the externally programmed speeds 164). This can allow the pump controller 26 to take flow rate and/or turnover rates into consideration even when operating to maintain pump speeds, as further described below. In addition, the flow locking feature can be active when the pump 32 and the motor 30 are being controlled in the flow control mode in accordance with one of the flow rate settings described above.

In one embodiment, when the flow locking feature is activated, an installer can follow a series of questions to set the minimum and maximum flow rates. In other words, the pump controller 26 and the menu 154 can provide additional checkpoints or methods to ensure that the minimum and maximum flow rates are not accidentally locked. Also, in some embodiments, once the minimum and maximum flow rates are locked, they cannot be changed by another installer or pool user. For example, as shown in the menu 154 of FIG. 6B, the flow locking category 176 can include a "set min flow" setting 212, a "set max flow" setting 214, an "activation" setting 216, a "permanently lock flow" setting 218, a "min/max flow acceptable" setting 220, and an "enable/disable" setting 222. As a result, an installer must first set the flow rates, activate the flow rates, permanently lock the flow rates, accept the flow rates, and enable the flow rates in order for the minimum and maximum flow rates to be locked. This can prevent accidentally locking of flow rates, since the pump controller 26 does not allow resetting of the minimum and maximum flow rates once they are initially locked. Once the series of settings are completed, the set minimum and maximum flow rates can become permanent parameters of the pumping system 10. In some embodiments, the minimum and maximum flow rates can be in a range from about 20 gallons per minute (GPM) to about 130 GPM or from about 20 GPM to about 140 GPM.

Once the pump controller 26 receives and sets the minimum and maximum flow rates, the pump controller 26 can disable further resetting of these flow rates, as described above. However, a user can continue to input and reprogram speed settings or flow rate settings (e.g., of the first set of speeds or flow rates 188, the second set of speeds or flow rates 190, or the externally programmed speeds or flow rates 192). The pump controller 26 can continue to operate as described above (for example, selecting a programmed flow rate based on a manual or scheduled run, or selecting a programmed flow rate requiring a highest motor speed if multiple scheduled runs are to take place at the same time), but may only operate the pump 32 and/or the motor 30 as long as the selected flow rate is between the minimum and maximum flow rates. In other words, when incorporating the flow locking feature, users can still have the ability to change scheduled or manual speeds and/or flow rates for different needs (e.g., water features, spa jets, cleaners, etc.), but the flow locking feature can prevent the user from programming a flow that could exceed a "safe" flow rate of the pumping system 10. As a result, the flow locking feature can allow the pump controller 26 to control speed and/or flow of a pump 32, but still prevent the pump 32 from exceeding the set maximum or minimum flow rates.

More specifically, when in the flow control mode, the flow locking feature can prevent programming or setting of flow rates of the first set of flow rates 188 and the second set of flow rates (e.g., by a user via the user interface 24 of the pump controller 24) that are outside of minimum/maximum flow rates. A user may be allowed to program flow rates of the externally programmed flow rates 192 (e.g., via the control/automation system 20) that are outside of the minimum/maximum flow rates. However, the flow locking feature causes the pump controller 26 to override these flow rates in order to operate the pump 32 to achieve the maximum flow rate (i.e., if the externally programmed flow rate 192 is above the maximum flow rate) or the minimum flow rate (i.e., if the externally programmed flow rate 192 is below the minimum flow rate). Thus, in some embodiments, within the master/slave relationship between the control/automation system 20 and the pump controller 26, the pump controller 26 (specifically, the flow locking feature) always maintains control over the minimum and maximum flow rates of the pumping system 10 despite being the slave controller.

In addition, when in the speed control mode, the flow locking feature can allow programming or setting of speeds of the first set of speeds 188 and the second set of speeds 190 (e.g., by a user via the user interface 24 of the pump controller 24), and of speeds of the externally programmed speeds 192 (e.g., via the control/automation system 20) that can achieve flow rates outside the minimum and maximum flow rates (i.e., below and above the minimum and maximum flow rates, respectively). However, the flow locking feature causes the pump controller 26 to alter these speeds in order to operate the pump 32 between the maximum flow rate and the minimum flow rate. In other words, a user can program speeds that would cause the pump 32 to operate outside of the minimum or maximum flow rate, but the pump controller 26 does not allow the pump to operate at the programmed speeds if this is the case. Rather, if the programmed speed were to result in a flow rate below the minimum flow rate or above the maximum flow rate, the pump controller 26 adjusts the speed until the resulting flow rate is at the minimum flow rate or at the maximum flow rate, respectively.

For example, an installer enables the flow locking feature and sets the maximum flow rate at 80 GPM. The pump controller 26 can then continuously monitor a current state of the pump system 10 (in particular, of the filter 14), in order to determine a pump motor speed necessary to achieve the maximum flow rate of 80 GPM and then set this pump motor speed as an upper speed limit. For example, the pump controller 26 can first determine that, based on the current state of the pump system 10, a pump motor speed of 3000 RPM is necessary to achieve the maximum flow rate of 80 GPM (e.g., using the flow control procedures described above), thereby setting 3000 RPM as the upper speed set point. The pump controller 26 is then programmed by a user in a speed control mode to operate the pump motor 30 at a speed of 3400 RPM. Due to the flow locking feature, the pump controller 26 will not operate the pump motor 30 at the 3400 RPM speed, but rather will only go up to the upper speed set point (i.e., 3000 RPM). Thus, the pump controller 26 will alter the programmed speed to maintain the flow rate at or under the maximum flow rate. Later, if the TDH in the pumping system 10 increases and the pump controller 26 determines that the pump motor 30 now requires a speed of 3150 RPM to generate a flow rate 80 GPM, the pump controller 26 sets the upper speed set point to 3150 RPM and increases the motor speed to 3150 RPM. Thus, the pump controller 26 continuously or periodically monitors the pumping system 10 and, if a programmed speed were to exceed the maximum flow rate, the pump controller 26 operates the motor 30 at the highest allowable speed below the programmed speed that achieves the maximum flow rate (i.e., at the upper speed set point) so that the pumping system 10 does not exceed the maximum flow rate.

In another example, an installer enables the flow locking feature and sets the minimum flow rate at 80 GPM. The pump controller 26 can then continuously monitor a current state of the pump system 10 in order to determine a pump motor speed necessary to achieve the minimum flow rate of 80 GPM, and then set this pump motor speed as a lower speed limit. For example, the pump controller 26 can first determine that, based on the current state of the pump system 10, a pump motor speed of 3000 RPM is necessary to achieve the minimum flow rate of 80 GPM, thereby setting 3000 RPM as the lower speed set point. The pump controller 26 is then programmed by a user in a speed control mode to operate the pump motor 30 at a speed of 2900 RPM. Due to the flow locking feature, the pump controller 26 will not operate the pump motor 30 at the 2900 RPM speed, but rather will only drop down to the lower speed set point (i.e., 3000 RPM). Thus, the pump controller 26 will alter the programmed speed to maintain the flow rate at or above the minimum flow rate. Later, if the TDH in the pumping system 10 increases and the pump controller 26 determines that the pump motor 30 now requires a speed of 3150 RPM to generate a flow rate 80 GPM, the pump controller 26 sets the lower speed set point to 3150 RPM and increases the motor speed to 3150 RPM. Thus, the pump controller 26 continuously or periodically monitors the pumping system 10 and, if a programmed speed were to exceed (i.e., go below) the minimum flow rate, the pump controller 26 operates the motor 30 at the lowest allowable speed above the programmed speed that achieves the minimum flow rate (i.e., at the lower speed set point) so that the pumping system 10 does not drop below the minimum flow rate.

In yet another example, an installer enables the flow locking feature and sets the maximum flow rate at 80 GPM and the minimum flow rate at 40 GPM. In this example, in the flow control mode, a user would not be allowed to program a flow rate in the pump controller menu 154 above 80 GPM or below 40 GPM. If the pump controller 26 is connected to the control/automation system 20, the user can program, via the control/automation system 20, a flow rate above 80 GPM or below 40 GPM. However, the pump controller 26 would override the programmed flow rate to operate the at 80 GPM (i.e., if the programmed flow rate was above 80 GPM) or at 40 GPM (i.e., if the programmed flow rate was below 40 GPM). In the speed control mode, a user would be allowed to program speeds exceeding those that would create flow rates above 80 GPM or below 40 GPM either through the pump controller menu 154 or through the control/automation system 20, but the pump controller 26 would alter the programmed speed to maintain a flow rate of 80 GPM (i.e., if the programmed speed would cause a flow rate above 80 GPM) or a flow rate of 40 GPM (i.e., if the programmed speed would cause a flow rate below 40 GPM).

Figure 7:
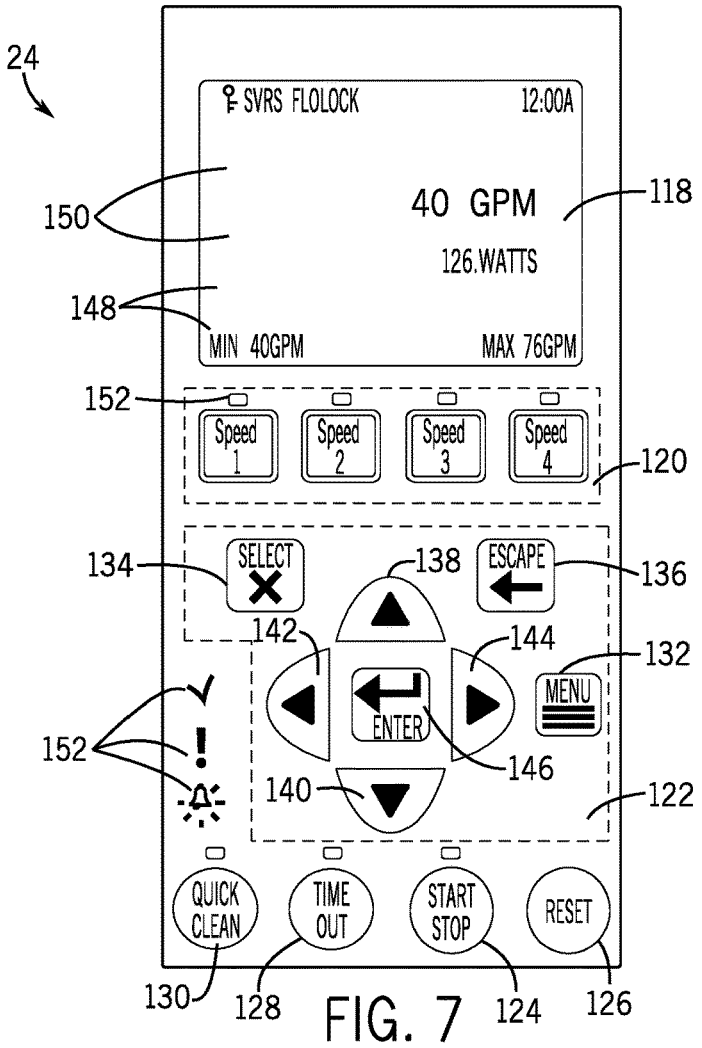
FIG. 7 is another front view of a user interface of a pump controller for use with the pool pump of FIG. 3.

FIG. 7 illustrates an example of the user interface 24 during a flow control mode when the flow locking feature is activated. As illustrated in FIG. 7, the display 128 shows the upper section 150 including a "password locked" key (indicating that access to programming the pump controller 26 is password protected), indications that the pumping system 10 is enabled with SVRS and flow locking ("FloLock") features, a current time, and a current flow rate. The lower section 148 indicates current power consumption as well as the minimum and maximum flow rates set through the flow locking feature.

Accordingly, with the flow locking feature enabled/activated, the pump controller 26 can still ensure that the flow rate for a desired turnover is met as conditions in the pumping system 10 change. More specifically, the pump controller 26 can detect, monitor, and maintain the flow rate by automatically adjusting the speed of the pump 32 as these conditions change (i.e., as the current state of the pumping system 10 changes), while also taking into consideration the set maximum and minimum flow rates. In other words, locking a maximum speed or flow rate may basically control how much water a pump 32 can move, but the flow rate can still be adjusted as the total dynamic head (TDH) of a pumping system 10 changes. An advantage of the flow locking feature is that an installer locks in an actual flow rate and the pump controller 26 can monitor the pumping system 10 for changes in TDH that affect flow rate, self adjust to maintain a specified flow rate, and still maintain the pumping system 10 within the set maximum and minimum flow rates.

Many health departments require that a minimum flow rate be maintained by a circulation system (i.e., fluid circuit) in commercial pools to maintain a turnover rate for water clarity and sanitation. This flow locking feature of embodiments of the invention can ensure such requirements are met. More specifically, in some embodiments, the minimum flow rate set by the flow locking feature can ensure a health department that a municipality will not slow the flow of the pump 32 down below commercial turnover standards (either for 24-hour time periods or shorter time periods). As a result, the flow locking feature can make variable speed technology more dependable and acceptable for use in commercial swimming pool applications. In addition, the maximum flow rate set by the flow locking feature can prevent the pump 32 from running at a flow rate that could exceed the flow rate specification of pool system components, such as a drain cover. For example, the flow locking feature can decrease the chance of an entrapment issue occurring by setting the maximum flow rate as the flow rate defined by local codes and the drain cover. Further, the maximum set flow rate can prevent a pipe between two drains from exceeding a velocity which would allow a "hold down" vacuum to be created on a covered drain. The maximum flow rate setting can also ensure that the flow rate of the pump 32 does not exceed what is recommended by energy efficiency codes.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A pumping system for at least one aquatic application, the pumping system comprising:

a pump;

a motor coupled to the pump; and a pump controller in communication with the motor, the pump controller including a user interface configured to initially receive and set a maximum locked flow rate, a minimum locked flow rate, and a plurality of programmed speed settings including a first programmed speed setting, the pump controller configured to disable resetting of the maximum flow rate and the minimum flow rate once they are initially received and set through the user interface, the pump controller configured to allow resetting of the plurality of programmed speed settings throughout operation of the pumping system, the pump controller configured to operate the motor at a first speed set by the first programmed speed setting as long as operating the motor at the first speed maintains a flow rate through the pumping system that is between the minimum locked flow rate and the maximum locked flow rate.

2. The pumping system of claim 1 wherein the pump controller is configured to operate the motor at an adjusted speed if operating the motor at the first speed maintains the flow rate outside the minimum locked flow rate and the maximum locked flow rate.

3. The pumping system of claim 2 wherein if operating the motor at the first speed maintains the flow rate below the minimum locked flow rate, the pump controller is configured to set the adjusted speed so that operating the motor at the adjusted speed maintains the flow rate at the minimum locked flow rate.

4. The pumping system of claim 2 wherein if operating the motor at the first speed maintains the flow rate above the maximum locked flow rate, the pump controller is configured to set the adjusted speed so that operating the motor at the adjusted speed maintains the flow rate at the maximum locked flow rate.

5. The pumping system of claim 1 wherein the pump controller is configured to determine the flow rate based on power consumption of the motor.

* * * * *